US007415860B2

(12) United States Patent
Yamauchi

(10) Patent No.: US 7,415,860 B2
(45) Date of Patent: Aug. 26, 2008

(54) METHOD AND APPARATUS FOR PRESSING SHEET MATERIAL

(75) Inventor: Takumi Yamauchi, Aichi-pref (JP)

(73) Assignee: Denso Corporation, Kariya (JP)

( * ) Notice: Subject to any disclaimer, the term of this patent is extended or adjusted under 35 U.S.C. 154(b) by 394 days.

(21) Appl. No.: 11/136,313

(22) Filed: May 24, 2005

(65) Prior Publication Data

US 2005/0262918 A1 Dec. 1, 2005

(30) Foreign Application Priority Data

May 31, 2004 (JP) ..... 2004-161806

(51) Int. Cl.
*B21D 13/02* (2006.01)

(52) U.S. Cl. ..... 72/385; 72/379.6; 72/380

(58) Field of Classification Search ..... 72/379.1, 72/379.6, 380, 383, 385
See application file for complete search history.

(56) References Cited

U.S. PATENT DOCUMENTS

| | | | | |
|---|---|---|---|---|
| 3,307,387 | A * | 3/1967 | Lacey, Jr. et al. | 72/379.6 |
| 3,874,214 | A | 4/1975 | Racicot | |
| 4,008,591 | A * | 2/1977 | Vos et al. | 72/385 |
| 4,450,706 | A * | 5/1984 | Engelmohr | 72/385 |
| 4,502,315 | A | 3/1985 | Dubrovsky et al. | |
| 4,989,440 | A * | 2/1991 | Sjogren | 72/385 |
| 5,694,803 | A * | 12/1997 | Ervin et al. | 72/379.6 |
| 7,080,540 | B2 * | 7/2006 | Taillepied et al. | 72/385 |

FOREIGN PATENT DOCUMENTS

| | | | |
|---|---|---|---|
| GB | 584575 | * | 1/1947 |
| GB | 1 323 843 | | 7/1973 |
| JP | 59-225825 | | 12/1984 |
| JP | 2001-137960 | | 5/2001 |
| JP | 2003-115567 | | 4/2003 |
| SU | 508302 | | 5/1976 |

* cited by examiner

*Primary Examiner*—David B Jones
(74) *Attorney, Agent, or Firm*—Harness, Dickey & Pierce, PLC

(57) ABSTRACT

An upper mold member 32 having an upstream upper punch 32*a*, an upper recess portion 32*b* and a downstream upper punch 32*c* that are serially arranged, from a feed upstream side of a sheet material W and a lower mold member 24 having an upstream lower punch 24*a*, a lower recess portion 24*b* and a downstream lower punch 24*c* that are serially arranged from the feed upstream side of the sheet material W are caused to displace towards a feed downstream side of the sheet material W while the upper mold member 32 and the lower mold member 24 sandwich the sheet material W between them. The productivity of a press apparatus can be improved and the cost can be reduced.

12 Claims, 22 Drawing Sheets

METHOD AND APPARATUS FOR PRESSING SHEET MATERIAL

BACKGROUND OF THE INVENTION

1. Field of the Invention

This invention relates to a method and an apparatus for pressing a sheet material, and is suitable for press machining a corrugated fin of a heat exchanger.

2. Description of the Related Art

Press machines for forming a continuous corrugated fin, having a continuous corrugated form, by pushing, from above and below, a group of punches onto a sheet material are known from Japanese Unexamined Patent Publication Nos. 2003-115567 and 2001-137960.

However, in the press machine according to Japanese Unexamined Patent Publication No. 2003-115567, each of the upper and lower punches constituted by an upper group of punches and a lower group of punches serially clamps and punches a sheet material with a good timing by using stepped cam plates to thereby execute press machining of corrugated fins. However, charging of the material and withdrawal of the product must be carried out, between the upper punch group and the lower punch group, before and after pressing.

In the press machine according to Japanese Unexamined patent Publication No. 2001-137960, however, pressing is conducted by controlling the vertical timing (press timing) of the group of punches, a feed amount of a material (sheet material) by a material feeder and its feed timing. In other words, because an independent material feeder for feeding the sheet material is necessary, productivity is low and the cost of the press machine is high.

Material conditions such as the thickness of the sheet material and the material of the sheet exert influences when the material feeder feeds the sheet material. Therefore, the sheet material is likely to slip, the fed sheet material undergoes deflection and the material slips when the group of punches clamp the material. For these reasons, the accuracy of the processed product is likely to drop.

SUMMARY OF THE INVENTION

In view of the problems described above, the invention aims, firstly, at improving productivity and reducing the cost of a press machine and, secondly, at improving processing accuracy of a sheet material in a press method for pressing the sheet material by a press machine.

According to an aspect of the invention for accomplishing the objects described above, there is provided a method for pressing a sheet material comprising a first step of forming the sheet material by fitting a first mold member and a second mold member in such a manner as to sandwich the sheet material between them, and a second step of causing the first mold member and the second mold member to displace in a feed downstream direction of the sheet material while the first mold member and the second mold member keep the state of the first step.

In the second step according to this press method, the first mold member and the second mold member are caused to displace in the feed downstream direction of the sheet material while the state of the first step in which the first mold member and the second mold member fit to each other while sandwiching the sheet material between them is kept as such. In other words, the sheet material can be fed without using the independent feeding device that is essentially necessary in Japanese Unexamined Patent Publication No. 2003-115567.

Therefore, because the press machine having a simple construction, and not having the feeding device of the sheet material, can execute pressing of the sheet material, the cost of the press machine of the sheet material can be reduced.

According to another aspect of the invention, there is provided a method for pressing a sheet material using a first upstream punch arranged on a first mold member; a first recess portion arranged on the first mold member on a more feed downstream side of a sheet material than the first upstream punch; a first downstream punch arranged on the first mold member on the more feed downstream side of the sheet material than the first recess portion; a second upstream punch arranged on the second mold member and formed into a shape fitting to the sheet material feed upstream side of the first upstream punch; a second recess portion arranged on the second mold member on the more feed downstream side of the sheet material than the second upstream punch and shaped into a shape fitting to the first upstream punch and to the first downstream punch; and a second downstream punch arranged on the second mold member on the more down stream side of the sheet material than the second recess portion and shaped into a shape fitting to the first recess portion; the first mold member and the second mold member fitting to each other while sandwiching the sheet material between them to thereby form the sheet material; the method comprising a first step of fitting the first upstream punch to the second recess portion and the first recess portion to the second downstream punch to thereby form the sheet material; a second step of causing the first mold member and the second mold member to undergo displacement in a feed downstream direction of the sheet material while the first mold member and the second mold member keep the state of the first step; a third step of separating the first mold member from the second mold member while the second mold member holds the sheet material and then causing the first mold member to undergo displacement to a feed upstream side of the sheet material; a fourth step of fitting the first recess portion to the second upstream punch and the first downstream punch to the second recess portion to thereby form the sheet material; and a fifth step of separating the second mold member from the first mold member while the first mold member holds the sheet material and then causing the second mold member to undergo displacement to the feed upstream side of the sheet material.

In the second step in this method, the first mold member and the second mold member are caused to undergo displacement in the feed downstream direction of the sheet material while the state of the first step, in which the first upstream punch fits to the second recess portion and the first recess portion fits to the second downstream punch, is kept as such. In other words, the sheet material is fed in the feed downstream direction. That is to say, the sheet material can be fed without using the independent feeding device of the sheet material that is indispensably necessary in Japanese Unexamined Patent Publication No. 2003-115567. Therefore, because the press machine having a simple construction, and not having the feeding device of the sheet material, can execute pressing of the sheet material, the cost of the press machine of the sheet material can be reduced.

In addition, because the sheet material is fed while the first mold member and the second mold member fit to each other, a slip of the material does not occur. In other words, the sheet material can be fed highly accurately and accuracy of the processed product can be improved.

After the second mold member undergoes displacement towards the feed upstream side while holding the sheet material in the third step, the first mold member fits to the second mold member in the fourth step. On the other hand, after the first mold member undergoes displacement towards the feed upstream side while holding the sheet material in the fifth step, the second mold member fits to the first mold member in the first step.

In other words, deviation of the material does not occur at the time of fitting (pressing) in the first mold member and the second mold member because the sheet material is processed while being held in the shape corresponding to the first recess portion or the second recess portion. Consequently, accuracy of the processed product can be further improved.

According to still another aspect of the invention, there is provided a method for pressing a sheet material comprising an upstream recess portion arranged on a first mold member; a downstream recess portion arranged on the first mold member on a more feed downstream side of a sheet material than the upstream recess portion; an upstream punch arranged on a second mold member and shaped into a shape fitting to the upstream recess portion and to the downstream recess portion; and a downstream punch arranged on the second mold member on a more feed downstream side of the sheet material than the upstream punch and shaped into a shape fitting to the upstream recess portion and to the downstream recess portion; the first mold member and the second mold member fitting to each other while sandwiching the sheet material between them to thereby form the sheet material; the method comprising a first step of fitting the upstream recess portion to the upstream punch and the downstream recess portion to the downstream punch to thereby form the sheet material; a second step of causing the first mold member and the second mold member to undergo displacement in a feed direction of the sheet material while the first mold member and the second mold member keep the state of the first step; a third step of separating the first mold member from the second mold member while the second mold member holds the sheet material and then causing the first mold member to undergo displacement to a feed upstream side of the sheet material; a fourth step of fitting the downstream recess portion to the upstream punch; and a fifth step of separating the second mold member from the first mold member while the first mold member holds the sheet material and then causing the second mold member to undergo displacement to the feed upstream side of the sheet material.

In the second step according to this method, the first mold member and the second mold member are caused to undergo displacement in the feed downstream direction of the sheet material while the state of the first step, in which the upstream recess portion and the upstream punch fit to each other and the downstream recess portion and the downstream punch fit to each other, is kept as such. In other words, the sheet material can be fed without using the independent feeding device of the sheet material that is indispensably necessary in Japanese Unexamined Patent Publication No. 2003-115567. Therefore, because the press machine having a simple construction not having the feeding device of the sheet material can execute pressing of the sheet material, the cost of the press machine of the sheet material can be reduced.

In addition, because the sheet material is fed while the first mold member and the second mold member fit to each other, slip of the material does not occur. In other words, the sheet material can be fed highly accurately and accuracy of the processed product can be improved.

After the second mold member undergoes displacement towards the feed upstream side while holding the sheet material in the third step, the first mold member fits to the second mold member in the fourth step. On the other hand, after the first mold member undergoes displacement towards the feed upstream side while holding the sheet material in the fifth step, the second mold member fits to the first mold member in the first step.

In other words, deviation of the material does not occur at the time of fitting (pressing) in the first mold member and the second mold member because the sheet material is processed while being held in the shape corresponding to the downstream recess portion or the downstream punch. Consequently, accuracy of the processed product can be further improved.

According to still another aspect of the invention, there is provided an apparatus for pressing a sheet material comprising a first mold member and a second mold member fitting to each other while sandwiching a sheet material between them; and displacement means for causing the first and second mold members to undergo displacement in a feed direction and a press direction of the sheet material.

The invention described above can provide a press apparatus of a sheet material capable of accomplishing the press method of the sheet material of the sheet material described above, that further includes a first upstream punch arranged on the first mold member; a first recess portion arranged on the first mold member on a more feed downstream side of a sheet material than the first upstream punch; a first downstream punch arranged on the first mold member on the more feed downstream side of the sheet material than the first recess portion; a second upstream punch arranged on the second mold member and having a shape fitting to the sheet material feed upstream side of the first upstream punch; a second recess portion arranged on the second mold member on the more feed downstream side of the sheet material than the second upstream punch and shaped into a shape fitting to the first upstream punch and to the first downstream punch; and a second downstream punch arranged on the second mold member on the more downstream side of the sheet material than the second recess portion and shaped into a shape fitting to the first recess portion.

The invention can further provide a press machine of a sheet material capable of accomplishing the press method described above that includes an upstream recess portion arranged on a first mold member; a downstream recess portion arranged on the first mold member on a more feed downstream side of a sheet material than the upstream recess portion; an upstream punch arranged on a second mold member and shaped into a form fitting to the upstream recess portion and to the downstream recess portion; and a downstream punch arranged on the second mold member on a more feed downstream side of the sheet material than the upstream punch and shaped into a shape fitting to the upstream recess portion and to the downstream recess portion.

The invention can further provide a press machine of a sheet material capable of accomplishing the press method described above that includes a first support member for causing the second mold member to hold the sheet material when the first mold member separates from the second mold member; and a second support member for causing the first mold member to hold the sheet material when the second mold member separates from the first mold member. According to this construction, the first support member causes the second mold member to hold the sheet material in the third step, and the second support member causes the first mold member to hold the sheet material in the fifth step.

In the press machine of a sheet material according to the invention, a cam mechanism may be used for displacement means.

The present invention may be more fully understood from the description of the preferred embodiments of the invention, as set forth below, together with the accompanying drawings.

BRIEF DESCRIPTION OF THE DRAWINGS

In the drawings:

FIGS. 9A and 9B are enlarged views of principal portions in FIG. 2, wherein FIG. 9A represents the former half of a third step and FIG. 9B represents the latter half of the third step;

FIGS. 11A and 11B are enlarged views of principal portions in FIG. 2, wherein FIG. 11A represents the former half of a fifth step and FIG. 11B represents the latter half of the fifth step;

FIGS. 13A and 13B show the support member in the first embodiment, wherein FIG. 13A is a view from a direction indicated by an arrow B in FIG. 12 and FIG. 13B is a view from a direction indicated by an arrow C in FIG. 13A;

FIGS. 16A and 16B are enlarged views of principal portions of the press machine according to the second embodiment, wherein FIG. 16A shows the former half of a third step and FIG. 16B shows the latter half of the third step;

FIGS. 18A and 18B are enlarged views of principal portions of the press machine according to the second embodiment, wherein FIG. 18A shows the former half of a fifth step and FIG. 18B shows the latter half of the fifth step.

DESCRIPTION OF THE PREFERRED EMBODIMENTS

First Embodiment

Figure 1:
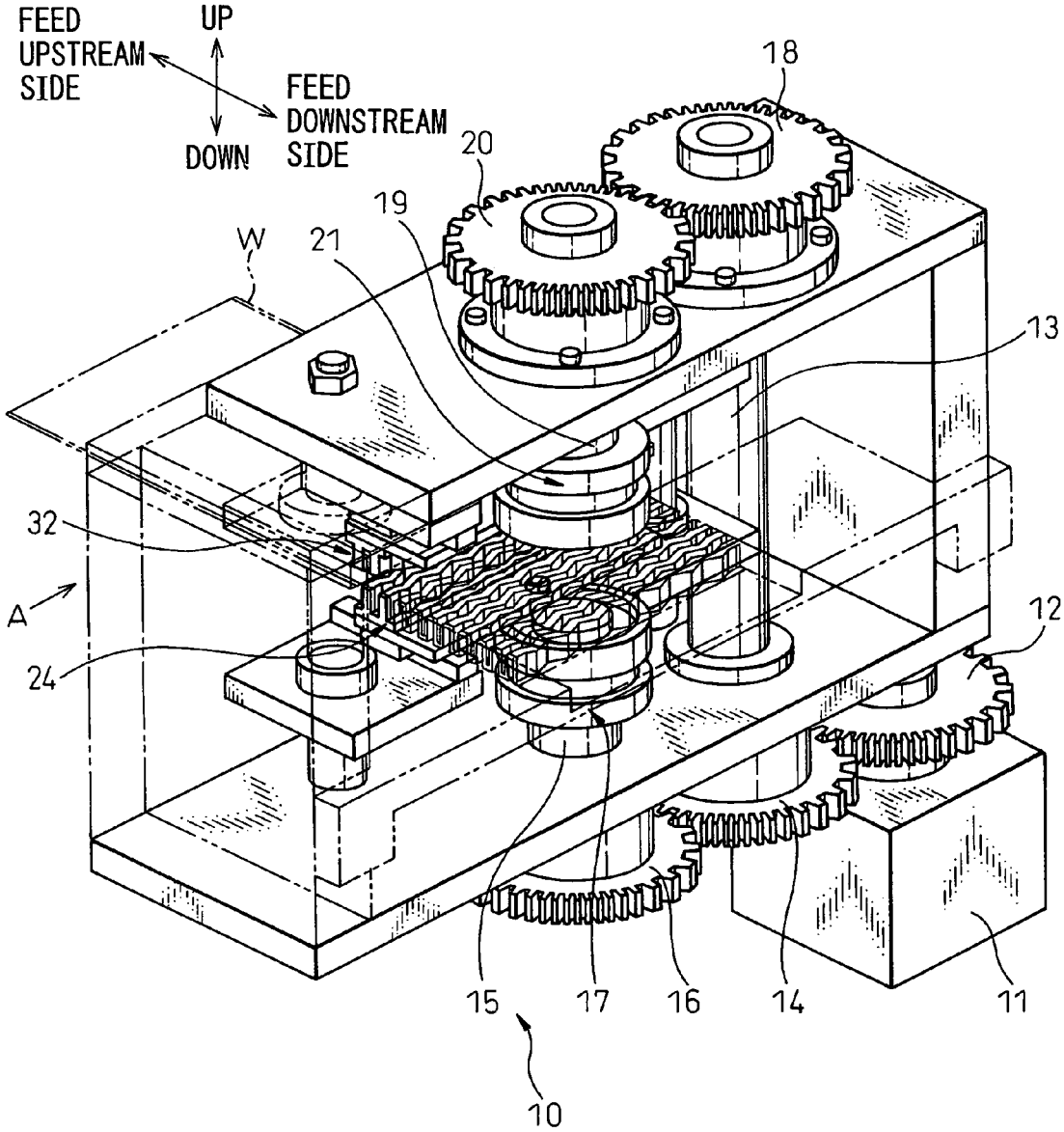
FIG. 1 is a perspective view of a press machine for corrugated fins according to a first embodiment of the invention.

FIG. 1 shows a press machine 10 for a sheet material according to the first embodiment of the invention. Up and down in the drawing represents up and down in the installation state of the press machine, and a feed upstream direction and a feed downstream direction represent upstream and downstream feed directions of the sheet material W, respectively.

Referring to FIG. 1, reference numeral 11 denotes a motor as a driving source, and a driving gear 12 is fixed to a motor rotary shaft. The driving gear 12 meshes with an intermediate lower gear 14 arranged and fixed to the lower end of an intermediate rotary shaft 13. The intermediate lower gear 14 meshes with a follower lower gear 16 that is fixed to a lower follower shaft 15 on which a lower cam portion 17 is formed. On the other hand, an intermediate upper gear 18 is arranged and fixed to the upper end of the intermediate rotary shaft 13. This intermediate upper gear 18 meshes with a follower upper gear 20 arranged and fixed to an upper follower shaft 19 on which an upper cam portion 21 is formed.

Figure 2:
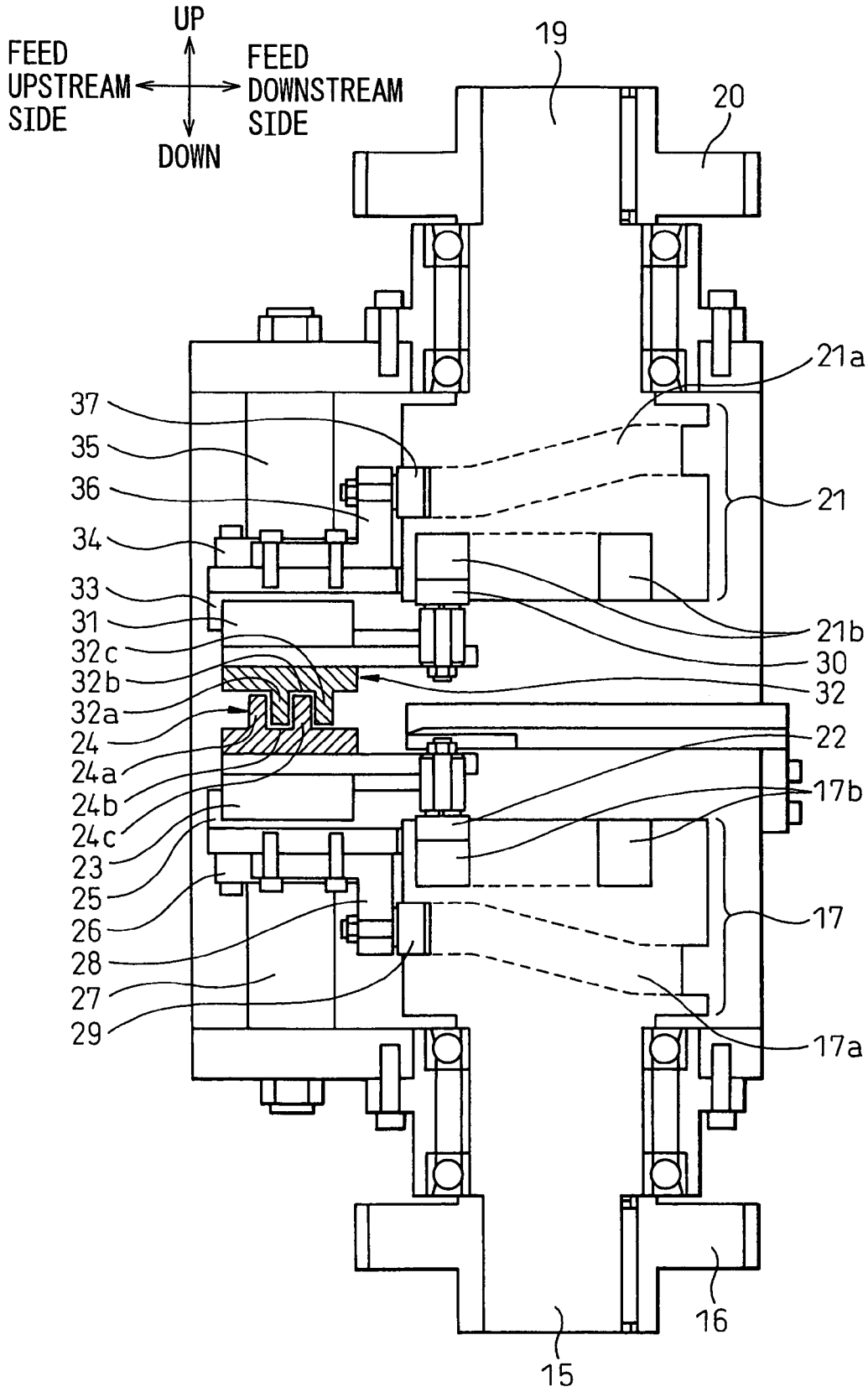
FIG. 2 is a partial sectional view from a direction indicated by an arrow A in FIG. 1.
Figure 3:
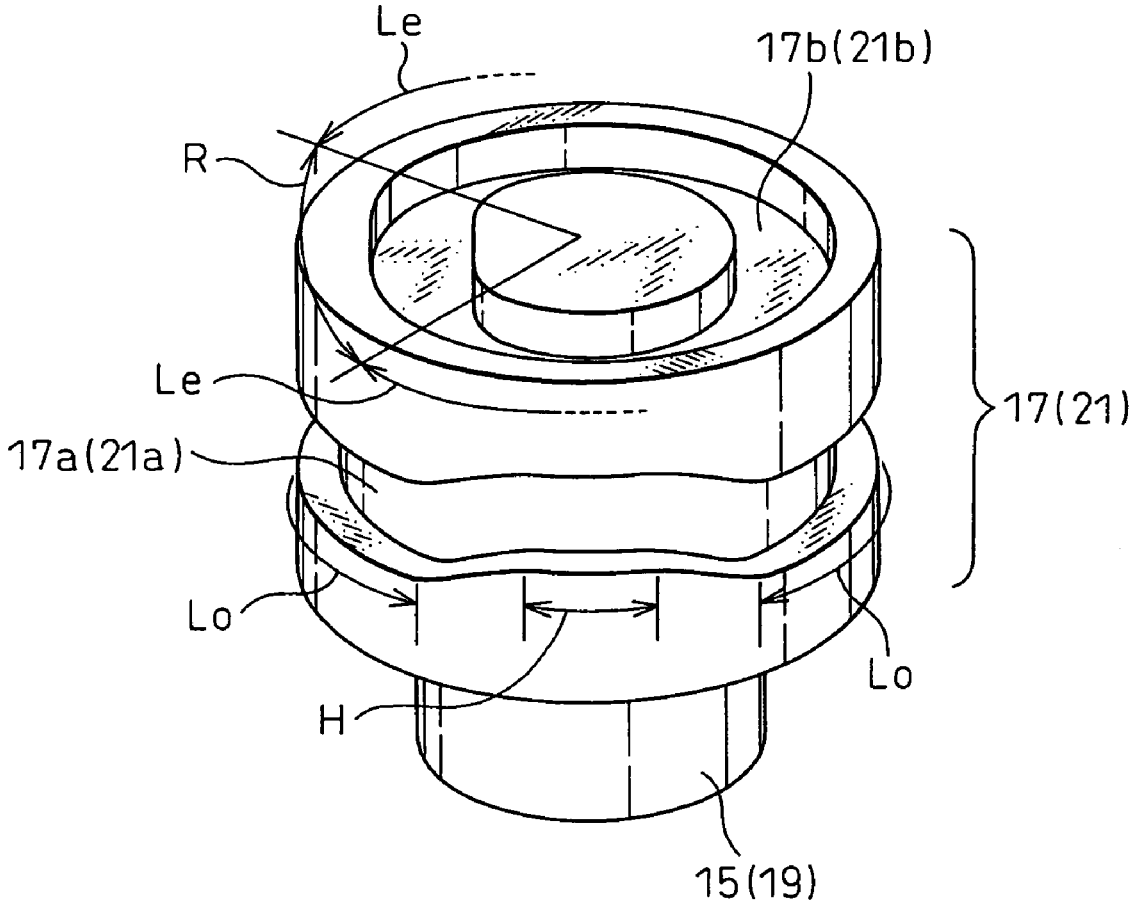
FIG. 3 is a perspective view showing a cam portion in the first embodiment.

A vertical cam groove 17*a* for causing displacement of a lower mold member 24 in a vertical direction and a cam groove 17*b* for causing its displacement in the feeding direction are formed in the lower cam portion 17 (see FIGS. 2 and 3). The feed cam groove 17*b* is formed on an end face at the upper part of the cylindrical lower cam portion 17 and has an Le portion for positioning the lower mold member 24 to the feeding upstream side (to the left side in FIG. 1) of the sheet material and an R portion for positioning it to the feed downstream side of the sheet material (to the right in FIG. 1).

A feed slide member 22 is fitted into the feed cam groove 17*b* in such a manner as to be capable of sliding. The feed slide member 22 is integrally fixed to a feed slider 23 having the lower mold member 24. The feed slider 23 is fitted to a feed side rail 25 in such a manner as to be capable of sliding in the feed direction. A vertical slider 26 is fixed to the feed slide rail 25. The vertical slider 26 is fitted to a vertical slide rail 27 in such a manner as to be capable of sliding in the vertical direction.

A vertical slide member 29 is fixed to the feed slide rail 25 through an intermediate member 28. The vertical slide member 29 is fitted into the vertical cam groove 17*a* so as to be capable of sliding. The vertical cam groove 17*a* is formed on a circumferential surface of the cylindrical lower cam portion 17, and have an H portion for positioning the lower mold member 24 to the upper side and an Lo portion for positioning it to the lower side.

A vertical cam groove 21*a* having an Lo portion and an H portion and a feed cam groove 21*b* having an R portion and an Le portion are similarly formed on the upper cam member 21 (the shape of the upper cam member 21 is represented by numerals inside parentheses in FIG. 3). A feed slide member 30 is fitted to the feed cam groove 21*b* in such a manner as to be capable of sliding. The feed slide member 30 is integrally fixed to a feed slider 31 having an upper mold member 32.

The feed slider 31 is fitted to a feed slide rail 33 in such a manner as to be capable of sliding in the feed direction. A vertical slider 34 is fixed to the feed slide rail 33. The vertical slider 34 is fitted to a vertical slider rail 35 in such a manner as to be capable of sliding in the vertical direction. A vertical slide member 37 is fixed to the feed slide rail 33 through an intermediate member 36. The vertical slide member 37 is fitted into the vertical cam groove 21*a* in such a manner as to be capable of sliding.

An upstream upper punch 32*a*, an upper recess portion 32*b* and a downstream upper punch 32*c* are serially arranged on the upper mold member 32 from the feed upstream side of the sheet material W. On the other hand, an upstream lower punch 24*a*, a lower recess portion 24*b* and a downstream lower punch 24*c* are serially arranged on the lower mold member 24 from the feed upstream side of the sheet material W. Both upstream and downstream upper punches 32*a* and 32*c* have shapes that fit to the lower recess portion 24*b*. Both upstream and downstream lower punches 24*a* and 24*c* have shapes that fit to the upper recess portion 32*b*.

Figure 4:
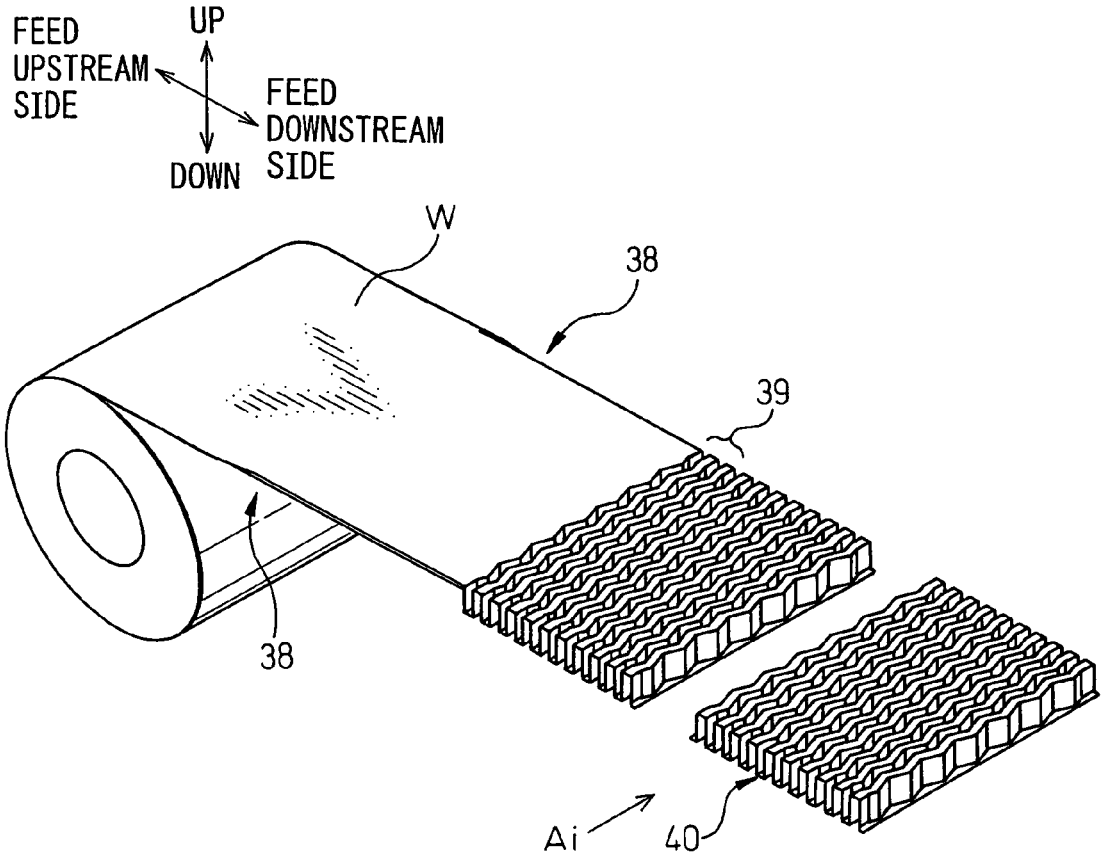
FIG. 4 is a perspective view showing a sheet material in the first embodiment.

FIG. 4 shows the sheet material W of this embodiment. This sheet material W is unwound from a coil state and is processed. The sheet material W uses a copper material having a thickness of 0.05 mm and a width of 141.5 mm but the thickness, the width and the material are not limited. Reference numeral 38 denotes a hem processing portion and both ends of the sheet material W are bent. Reference numeral 39 denotes a press processing portion. The sheet material W is processed into corrugate fins by pressing by the upper mold member 32 and the lower mold member 24. Incidentally, reference numeral 40 denotes a complete product after cutting. This embodiment represents an example of wave fins for making the flow of air inflowing from a direction indicated by an arrow Ai zigzag and for improving heat exchange efficiency under the product condition.

Figure 5A:
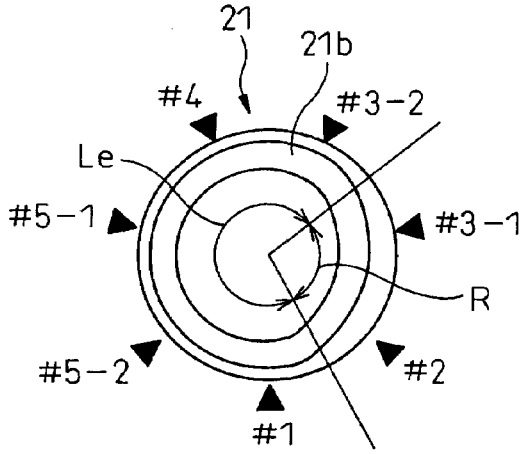
FIG. 5A slows a feed cam groove of an upper cam portion according to the first embodiment and FIG. 5B shows a vertical cam groove of the upper cam portion.
Figure 5B:
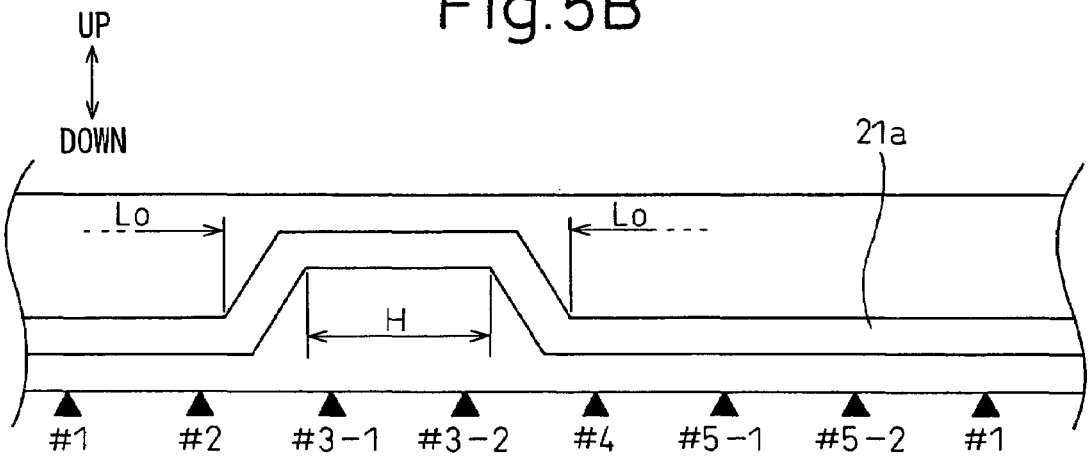
Figure 6A:
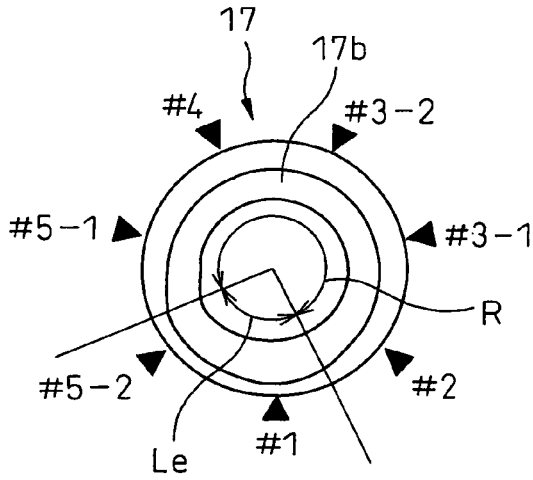
FIG. 6A shows a feed cam groove of a lower cam portion according to the first embodiment and FIG. 6B shows a vertical cam groove of the lower cam portion.
Figure 6B:
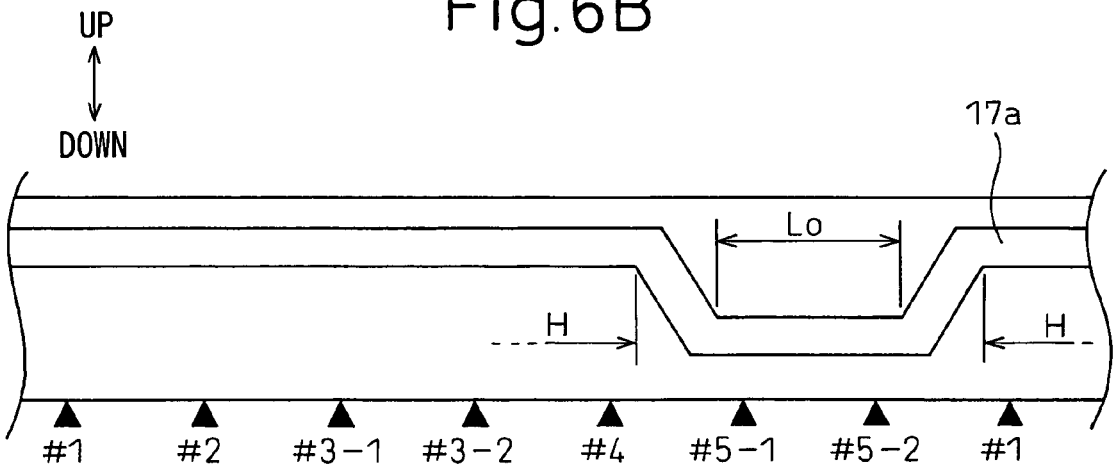

Next, the operation of this embodiment having the construction described above will be explained with reference to schematic views (FIGS. 5A, 5B and 6) of the cam grooves 17*a*, 17*b*, 21*a* and 21*b* of the vertical cam portions 17 and 21 and FIGS. 7 to 11B.

When the motor 11 operates, the driving gear 12 rotates and the intermediate lower gear 14 meshing with the driving gear 12 rotates. At this time, the intermediate upper gear 17 rotates in the interlocking arrangement through the intermediate shaft 13, too. The turning force of the intermediate lower gear 14 is transmitted to the follower lower gear 16 to thereby rotate the lower follower shaft 15 (lower cam portion 17) that is integral with the follower lower gear 16. On the other hand, the turning force of the intermediate upper gear 18 is transmitted to the follower upper gear 20 to thereby rotate the upper follower shaft 19 (upper cam portion 21) that is integral with the follower upper gear 20.

Figure 7:
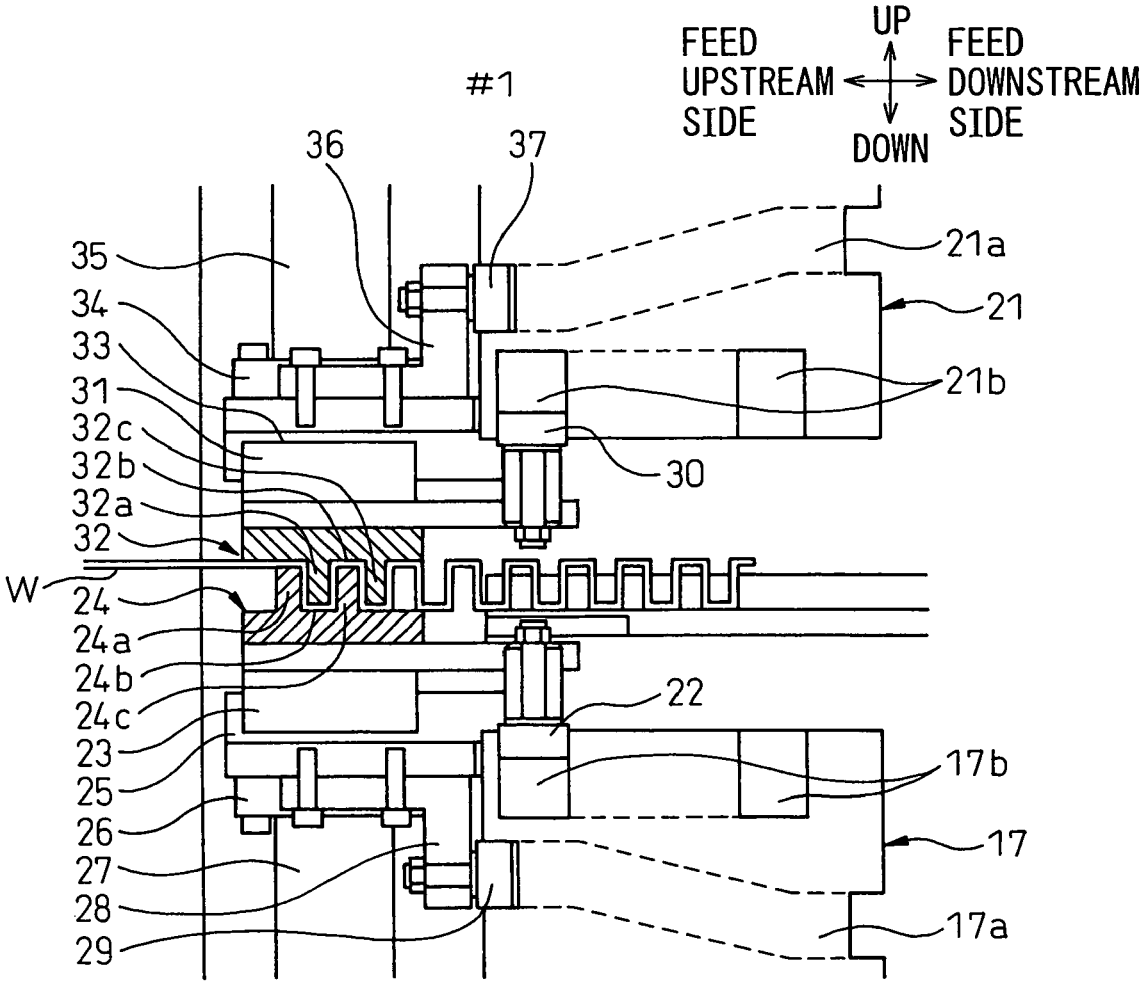
FIG. 7 is an enlarged view of principal portions in FIG. 2 and represents a first step.
Figure 8:
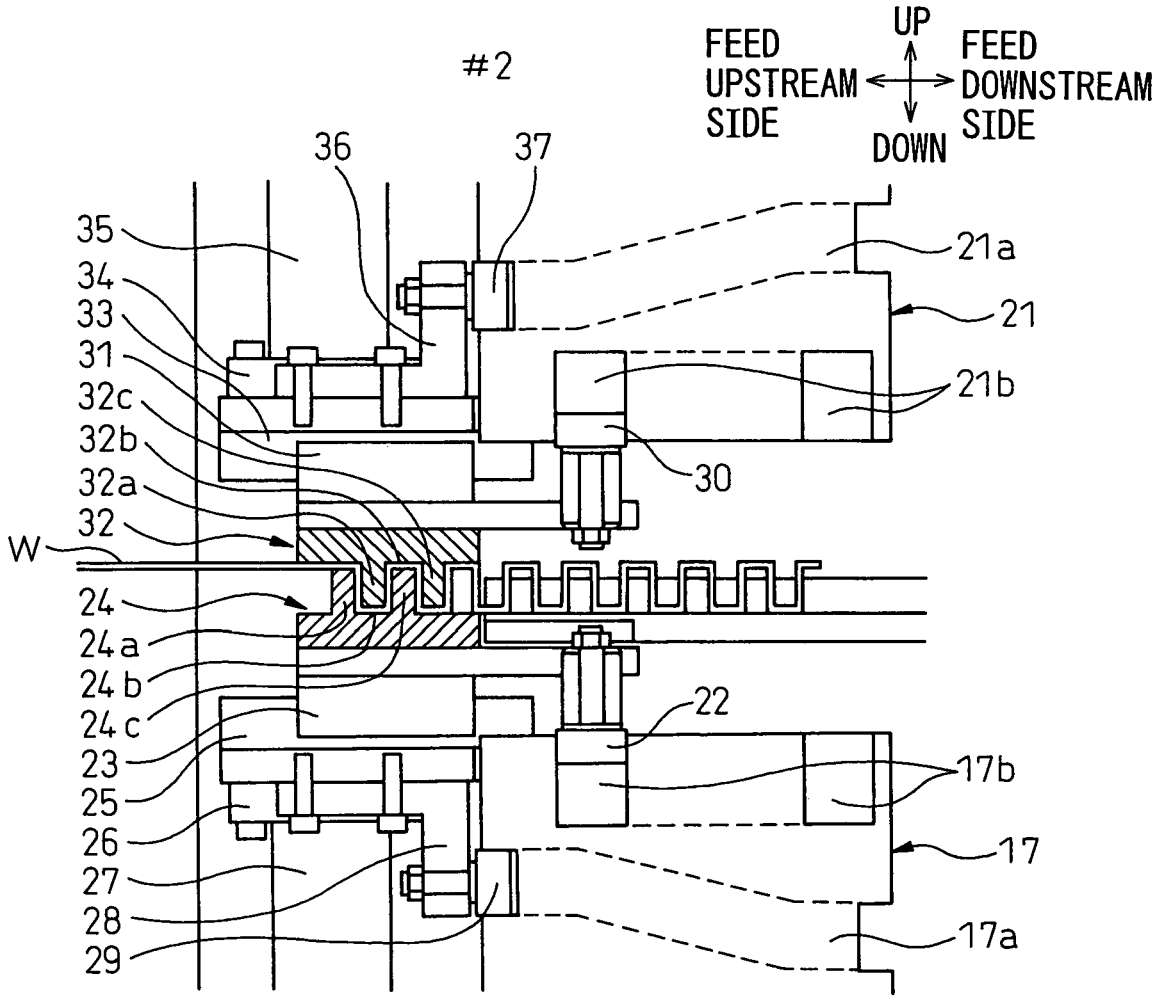
FIG. 8 is an enlarged view of principal portions in FIG. 2 and represents a second step.

The first step (#1) in FIG. 7 represents the state where the upper and lower mold members 24 and 32 fit to each other (press state). At this time, the upstream upper punch 32*a* and the lower recess portion 24*b* fit to each other and the upper recess portion 32*b* and the downstream lower punch 24*b* fit to each other.

The feed slide members 22 and 30 and the upper and lower slide members 29 and 37 in the first step (#1) are positioned at a position #1 of the cam groove shown in FIGS. 5A, 5B, 6A and 6B. Because the feed cam groove 21*b* of the upper cam portion 21 is formed at the position Le, the feed slide member 30, that is, the upper mold member 32, is positioned on the sheet material feed upstream side (to the left in FIG. 7). On the other hand, the vertical cam groove 21*a* is formed at the position Lo and the vertical slide member 37 or the upper mold member 32 is positioned to the lower side. The feed cam groove 17*b* of the lower cam portion 17 is formed at the position Le and the vertical cam groove 17*a* is formed at the position H. Therefore, the lower mold member 24 is positioned on the left and upper side in FIG. 7.

When the motor 11 is operated and the upper and lower cam portions 17 and 21 are rotated from the state of the first step (#1), the slide members 22 and 30 and the upper and lower slide members 29 and 37 undergo displacement along the cam grooves 17*a*, 17*b*, 21*a* and 21*b*. The upper and lower mold members 24 and 32 undergo displacement to the downstream side while pressing the sheet material W. In other words, the sheet material W is fed towards the feed downstream side (second step #2 in FIG. 8).

Figure 9A:
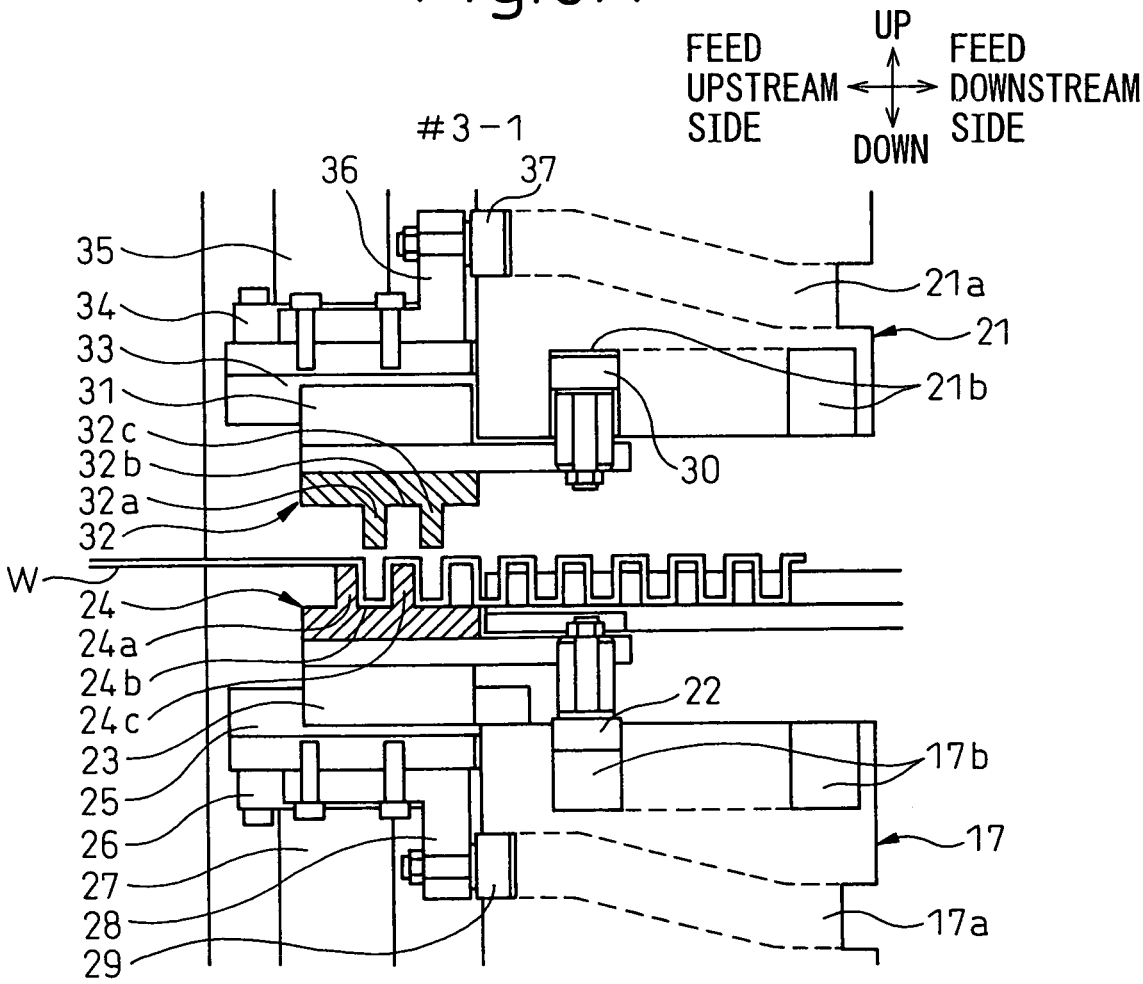

When the upper and lower cam portions 17 and 21 further rotate from the second step (#2), the feed slide members 22 and 30 and the upper and lower slide members 29 and 30 undergo displacement along the cam grooves 17*a*, 17*b*, 21*a* and 21*b* and the upper mold member 32 is caused to move up (former half of third step (#3-1) and FIG. 9A). In other words, the vertical slide member 37 integral with the upper mold member 32 moves up along the vertical cam groove 21*a* of the upper cam portion 21 (see FIG. 5B). At this time, the sheet material W is held by the lower mold member 24. The holding method will be described later.

Figure 9B:
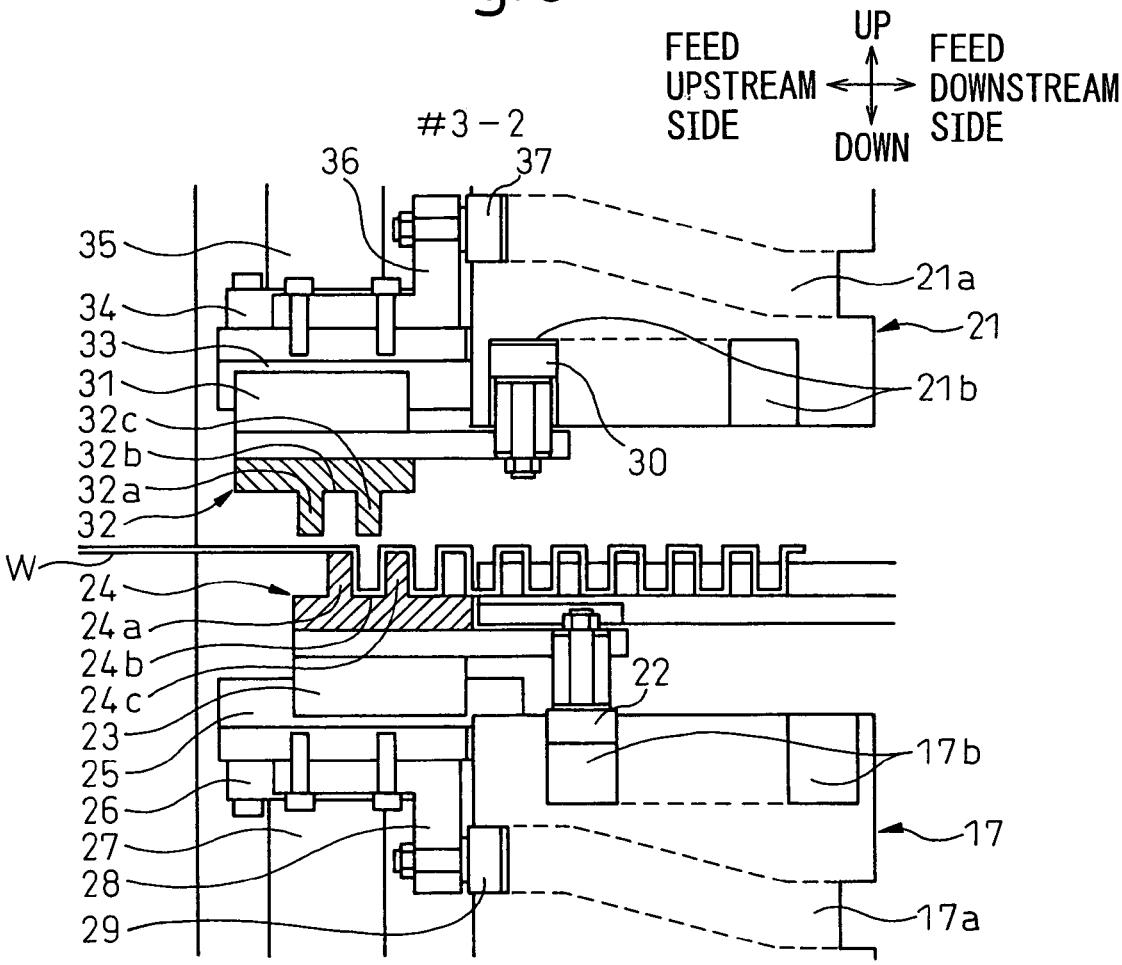

After moving up, the upper mold member 32 displaces towards the feed upstream side of the sheet material W (latter half of third step (#3-2); FIG. 9B). In other words, the feed slide member 30 integral with the upper mold member 32 displaces towards the feed upstream side along the feed cam groove 21*b* of the upper cam portion 21 (see FIG. 5A).

Figure 10:
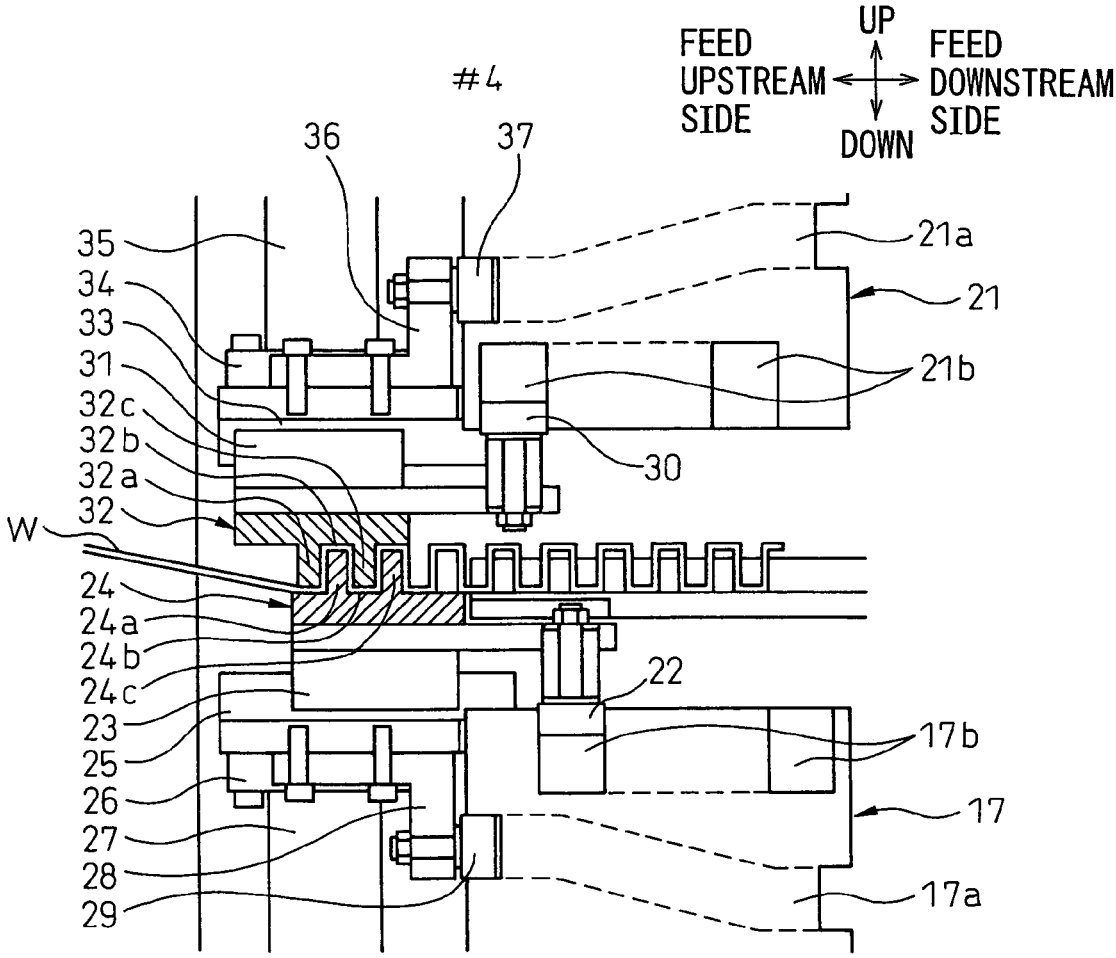
FIG. 10 is an enlarged view of principal portions in FIG. 2 and represents a fourth step.

Thereafter, the upper mold member 32 is moved down and the sheet material W is pressed (fourth step #4; FIG. 10). In other words, the vertical slide member 37 integral with the upper mold member 32 moves down along the vertical cam groove 21*a* of the upper cam portion 21 (see FIG. 5). At this time, the upper recess portion 32*b* and the upstream lower punch 24*a* fit to each other and the downstream upper punch 32*c* and the lower recess portion 24*b* fit to each other.

Figure 11A:
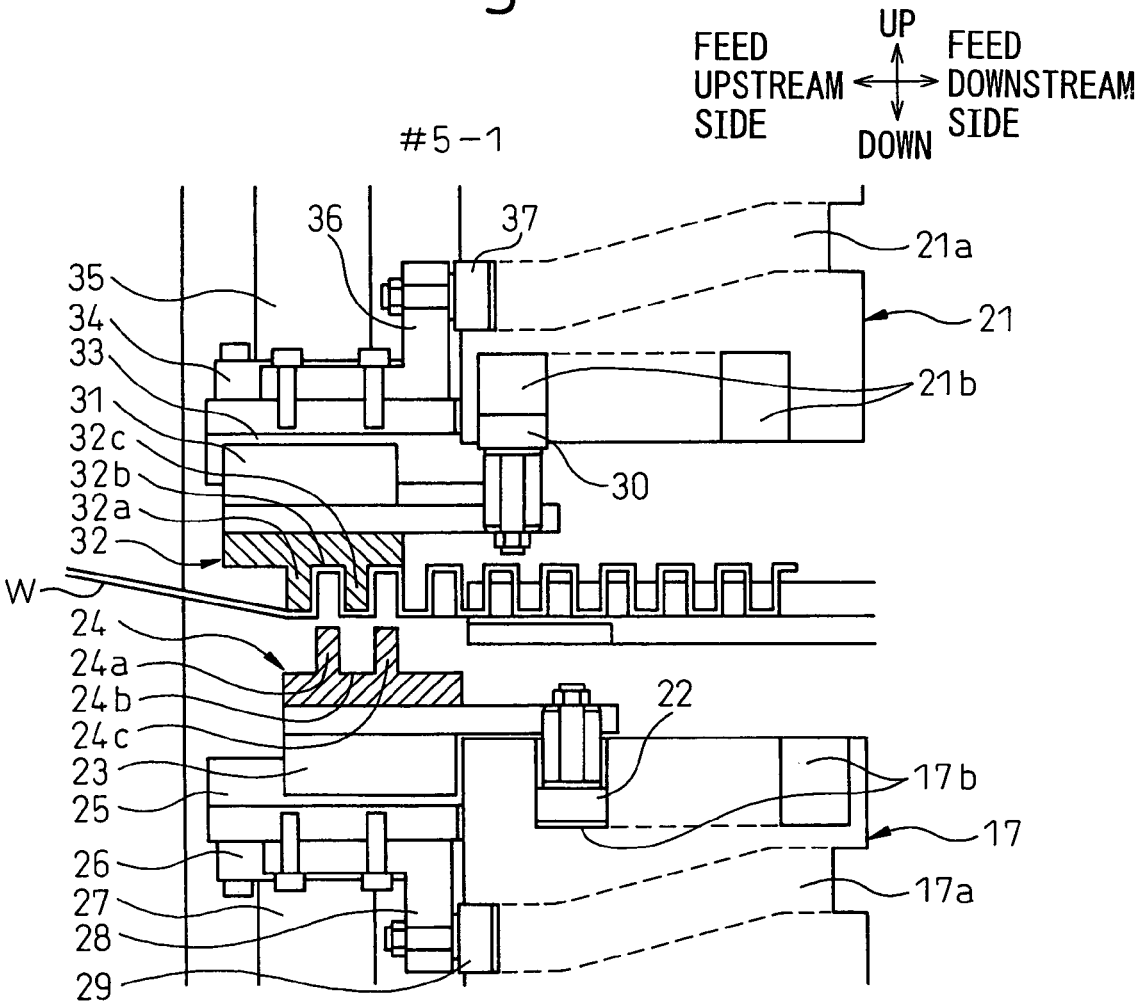

Next, the lower mold member 24 moves down (former half of fifth step (#5-1); FIG. 11A). In other words, the vertical slide member 29 integral with the lower mold member 24 moves down along the vertical cam groove 17*a* of the lower cam portion 17 (see FIG. 6B). At this time, the sheet material W is held by the upper mold member 32. The holding method will be described later.

Figure 11B:
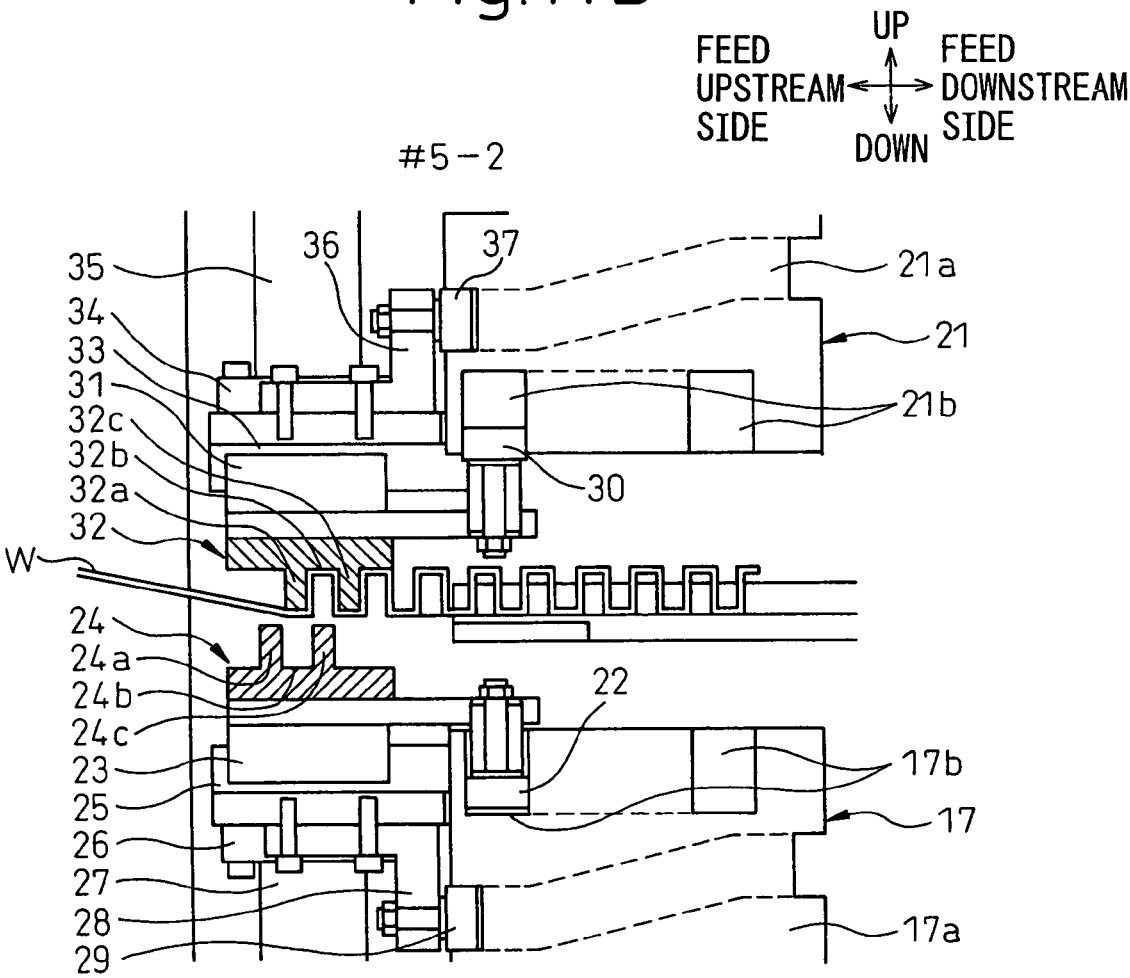

After moving down, the lower mold member 24 undergoes displacement towards the feed upstream side of the sheet member W (latter half of fifth step (#5-2); FIG. 11B). In other words, the feed slide member 22 integral with the lower mold member 24 undergoes displacement towards the feed upstream side along the feed cam groove 17*b* of the lower cam portion 17 (see FIG. 6A). Thereafter, the lower mold member 24 moves up and the state of the first step (#1) is reached.

Next, holding of the sheet material W by the mold members 24 and 32 in the third step (#3) and in the fifth step (#5) will be explained with reference to FIGS. 12, 13A and 13B. The afore-mentioned hem processing is applied to the sheet material W on the feed upstream side of the press portion 39 at which the upper mold member 32 and the lower mold member 24 fit to each other. This hem processing is executed by a hem processing roller (not shown). As the sheet material W that is hem-processed is sandwiched between an upper support member 41 and a lower support member 42, the condition of the sheet material W pulled into the press machine 10 becomes constant. An upper guide portion 41*a* and a lower guide portion 42*a* protrude from the upper support member 41 and the lower support member 42, respectively. Incidentally, a first support member in the scope of claim corresponds to the upper guide portion 41*a* and a second support member, to the lower guide portion 42*a*.

Two each of the upper and lower guide portions 41*a* and 42*a* are arranged and positioned inside slits 24*d* and 32*d* formed at both ends of the upper and lower mold members 32 and 24. The upper guide portion 41*a* prevent the sheet material W from floating up from the lower mold member 24 when the upper mold member 32 moves up in the third step. The lower guide portion 42*a* prevent the sheet material W from floating up from the upper mold member 32 when the lower mold member 24 moves down in the fifth step. The width t of these slits 24*d* and 32*d* is about 1 mm and does not at all affect forming of the corrugated fins.

Figure 12:
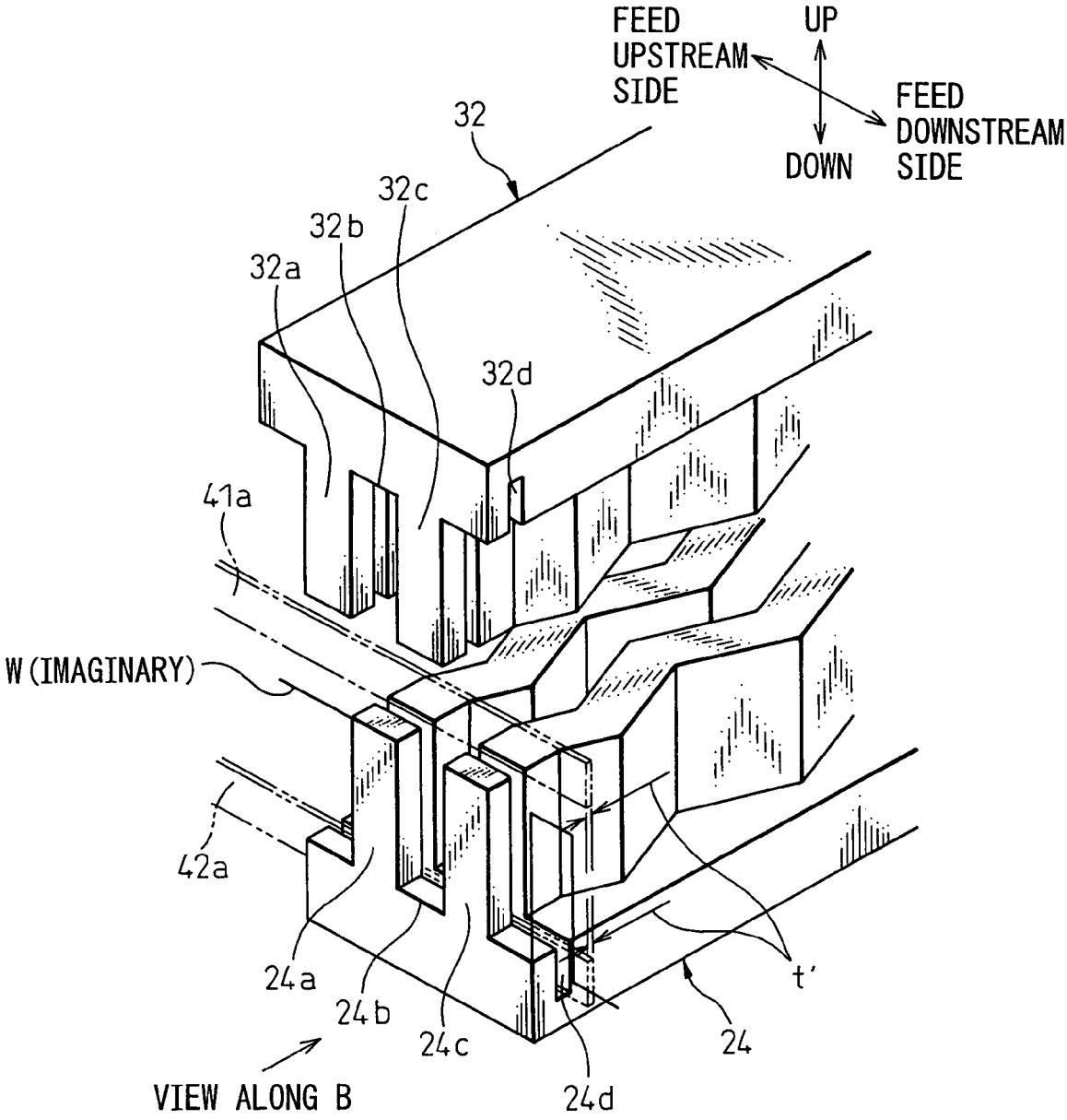
FIG. 12 is a perspective view showing a mold member and a support member in the first embodiment.
Figure 13A:
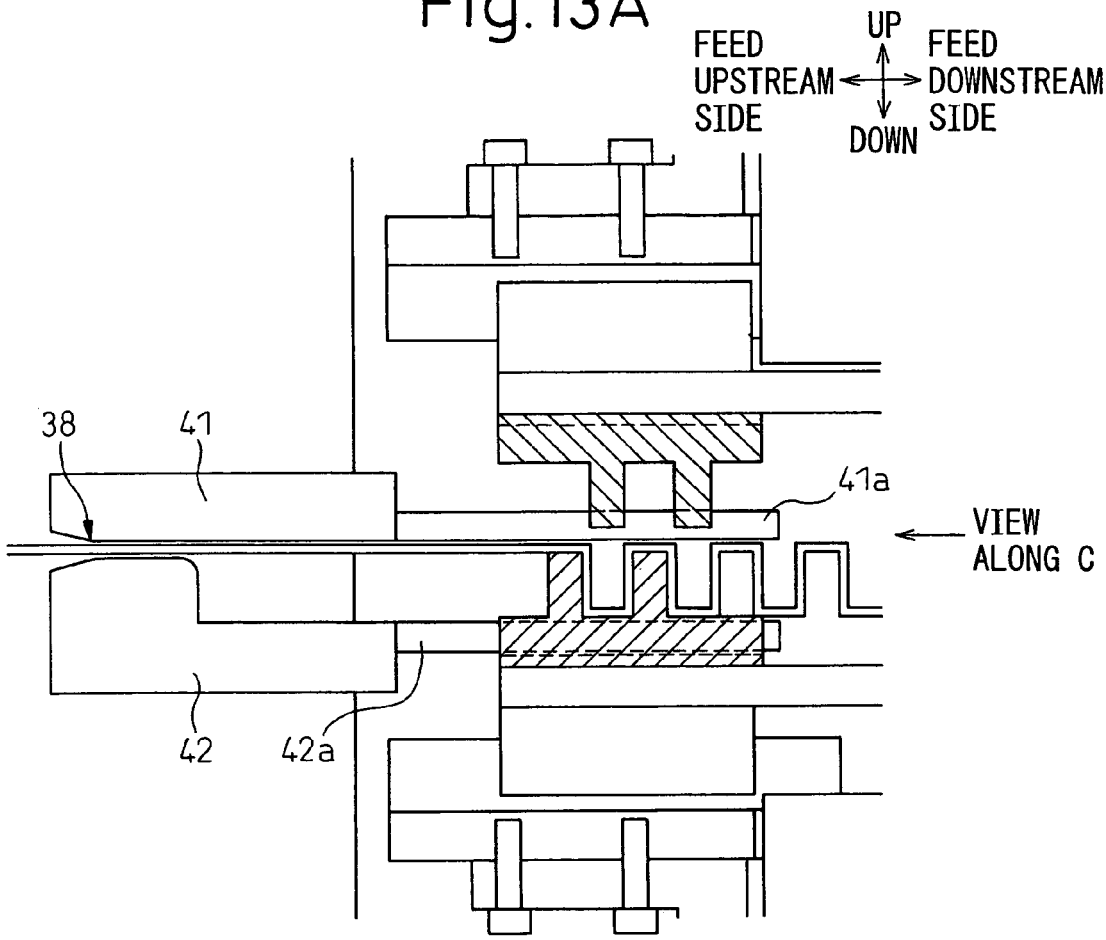
Figure 13B:
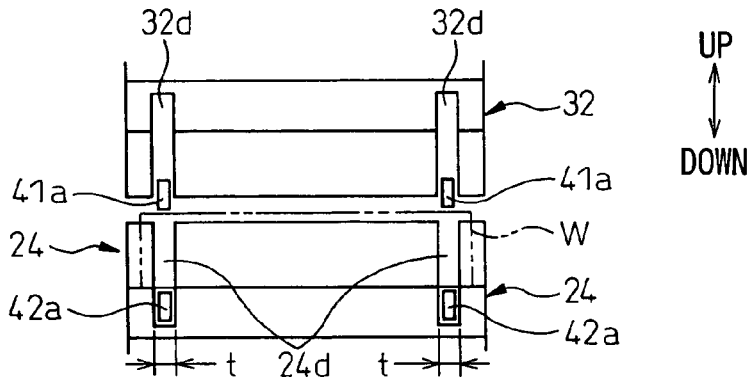

FIGS. 12, 13A and 13B show the state of the third step. The upper guide portion 41*a* keep contact with the sheet material W and prevent the sheet material W from floating from the lower mold member 24.

Next, the function and effect of the first embodiment will be listed. (1) Because the sheet material W is allowed to displace in the feed downstream direction while the upper mold member 32 and the lower mold member 24 fit to each other (press), a material feeding device can be eliminated.

More specifically, the cam grooves 17*a*, 17*b*, 21*a* and 21*b* fit the upstream upper punch 32*a* to the lower recess portion 24*b* and the upper recess portion 32*b* to the downstream lower punch 24*c* and cause displacement of the upper and lower mold members 32 and 24 in the feed downstream side while keeping that state. In other words, they feed the sheet material W in the feed downstream direction. Therefore, the invention can eliminate the feeding device of the sheet material W that is indispensably necessary in Japanese Unexamined Patent Publication No. 2003-115567 and can reduce the cost of the press machine.

(2) Accuracy of the product can be improved because slip and deviation of the material do not exist during feed of the sheet material W and during pressing by the upper and lower mold members 24 and 32.

More specifically, because the sheet material W is fed in the second step (#2) under the state where the upper and lower mold members 32 and 24 fit to each other, slip of the material does not occur irrespective of the thickness of the material and its constituent material, and the sheet material W can be fed highly accurately.

The upper mold member 32 fits to the lower mold member 24 in the fourth step (#4) after the lower mold member 24 displaces towards the feed upstream side while the lower mold member 24 holds the sheet material W in the third step (#3-1, #3-2). On the other hand, the lower mold member 24 fits to the upper mold member 32 in the first step (#1) after the upper mold member 32 displaces to the feed upstream side while holding the sheet material W in the fifth step (#5-1, #5-2). In other words, the upper mold member 32 and the lower mold member 24 execute pressing of the sheet material W that is restricted in the form corresponding to the upper recess portion 32*b* or to the lower recess portion 24*b*. Therefore, deviation of the material does not occur. These effects can further synergistically improve the accuracy of the product.

(3) The upper guide portion 41*a* and the lower guide portion 42*a* are arranged in the slits 24*d* and 32*d* formed in the upper and lower mold members 24 and 32. Therefore, it is possible to prevent the sheet material W from floating from the mold members 24 and 32 when the upper mold member 32 and the lower mold member 24 separate from each other in the third step (#3) and the fifth step (#5).

Incidentally, a method that sucks the sheet material W from air ports arranged in the mold members 24 and 32 may be available as a method for holding the sheet material W to the mold members 24 and 32. However, because this method requires a large scale apparatus, the cost of the press machine increases. A method that attracts the sheet material W to the mold members 24 and 32 by the magnetic force may be available, too, but the sheet material W cannot be attracted to the mold members 24 and 32 when the sheet material W is formed of a non-magnetic material.

Because this embodiment includes the upper and lower guides 41*a* and 42*a* for preventing the sheet material W from floating from the mold members 24 and 32 while keeping contact with the sheet material W, however, the embodiment can prevent floating of the sheet material W from the upper and lower mold members 32 and 26 even when the large scale attraction apparatus of the sheet material W by air does not exist. Because this embodiment prevents floating of the sheet material from the mold members 24 and 32 while keeping contact with the sheet material W, floating of the non-magnetic material can be prevented, too.

(4) Displacement of the mold members 24 and 32 is controlled by the cam grooves 17*a*, 17*b*, 20*a* and 20*b* of the cam portions 17 and 21. Therefore, when the motor 11 is continuously operated, press machining of the corrugated fins can be carried out by continuously executing the first to fifth steps (#1-#5).

Second Embodiment

Unlike the first embodiment, in the press machine according to the second embodiment shown in FIGS. 14 to 18B, the upstream recess portion 32*f*, the intermediate recess portion 32*g* and the downstream recess portion 32*h* are formed serially in the upper mold member 32 from the feed upstream direction of the sheet material W. On the other hand, an upstream punch 24*f*, an intermediate punch 24*g* and a downstream punch 24*h* are formed serially in the lower mold member 24 from the feed upstream direction of the sheet material W. Incidentally, the downstream recess portion in the scope of claim corresponds to the intermediate recess portion 32*g* in this embodiment and the downstream punch corresponds to the intermediate punch 24*g*. The intermediate recess portion 32*g* has a shape that fits to the upstream punch 24*f* and to the intermediate punch 24*g* and the downstream recess portion 32*h* has a shape that fits to the intermediate punch 24*g* and to the downstream punch 24*h*.

In this embodiment, the feed sliders 23 and 31 fitting to the feed slide rails 25 and 33 in such a manner as to be capable of displacement in the horizontal (feed) direction are caused to displace by a hydraulic device (a device for changing pressure to oil inside cylinder and displacing an object; not shown in the drawings) as a displacement means. Therefore, the mold members 24 and 32 fixed to the feed sliders 23 and 31 can undergo displacement in the feed direction. On the other hand, as the feed slide rails 25 and 33 are caused to displace as a whole in the vertical direction by the hydraulic device (displacement means), the mold members 24 and 32 can displace in the vertical direction.

Figure 14:
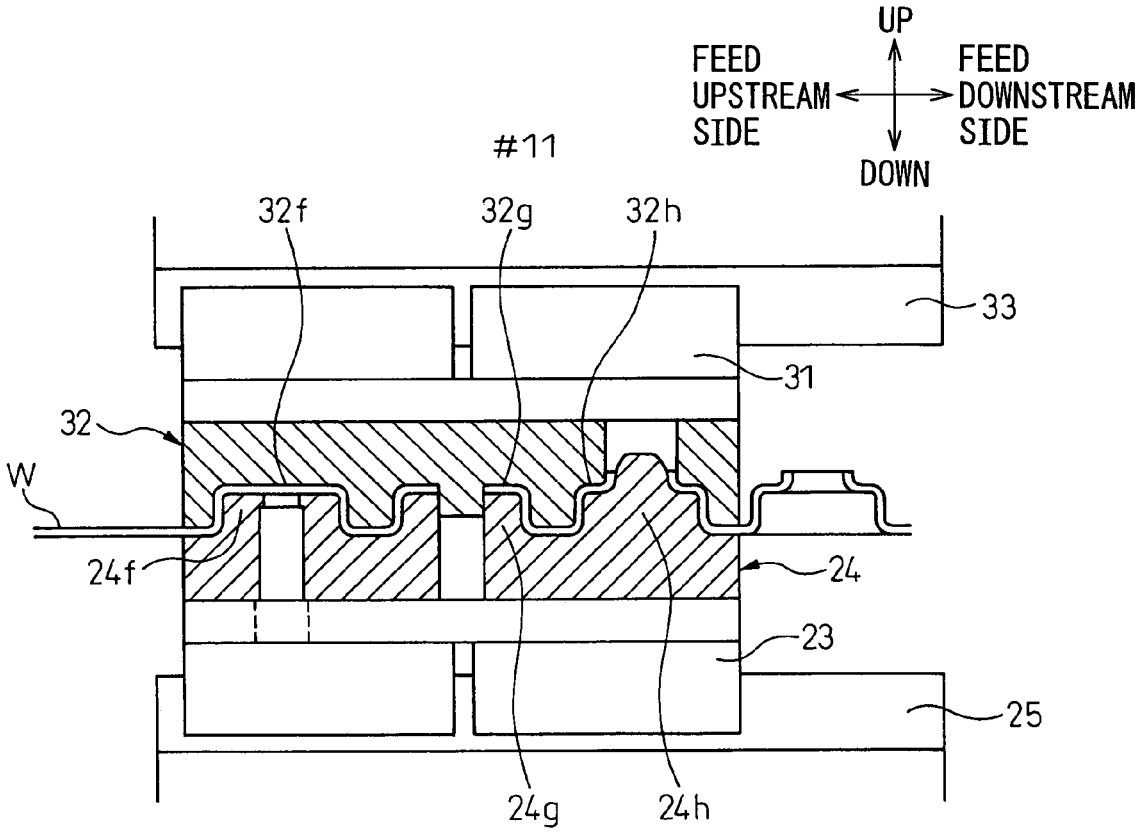
FIG. 14 is an enlarged view of principal portions of a press machine according to a second embodiment and shows a first step.

Next, the operation in the second embodiment will be explained. The first step (#11) in FIG. 14 represents the state where the upper and lower mold members 32 and 24 fit to each other (press state). At this time, the upstream recess portion 32*f* and the upstream punch 24*f*, the intermediate recess portion 32*g* and the intermediate punch 24*g* and the downstream recess portion 32*h* and the downstream punch 24*h* fit to one another, respectively. Here, when the upstream recess portion 32*f* and the upstream punch 24*f* fit to each other, the sheet material W has a projection shape corresponding to the shape of the upstream punch 24*f*. When the downstream recess portion 32*h* and the downstream punch 24*h* fit to each other, burring is applied to the later-appearing lower port portion formed in the sheet material W.

Figure 15:
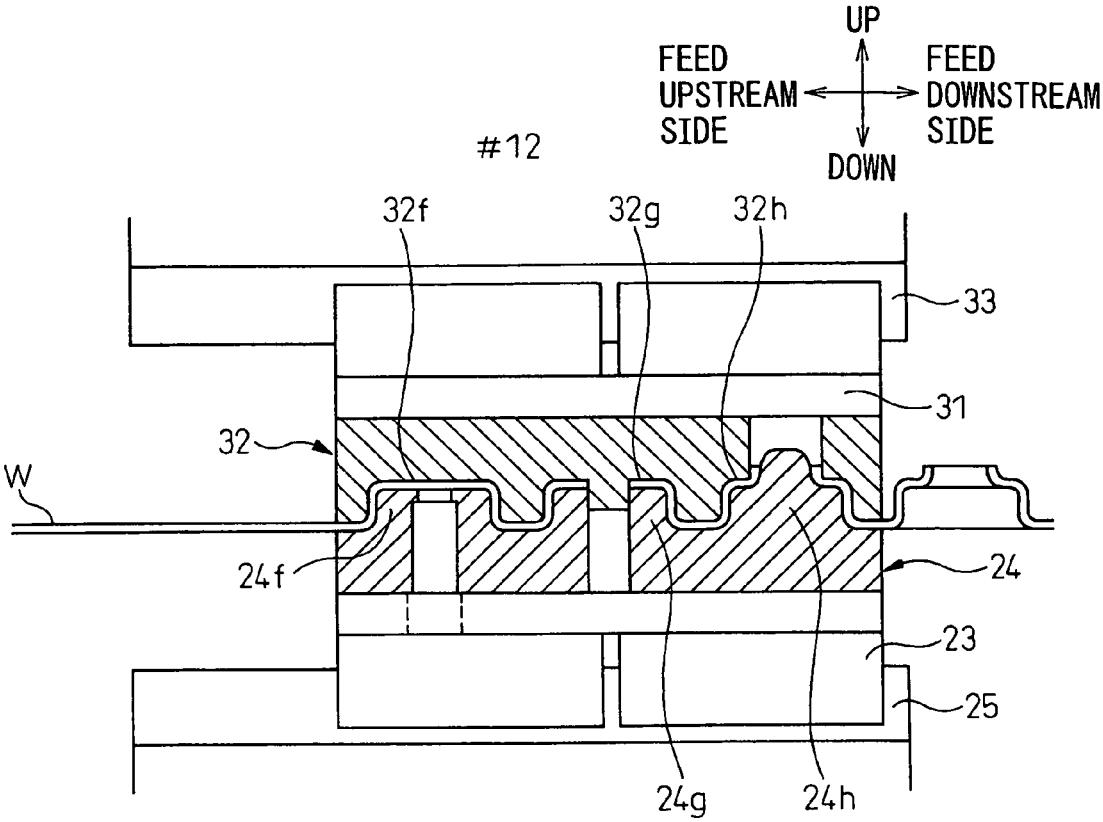
FIG. 15 is an enlarged view of principal portions of the press machine according to the second embodiment and shows a second step.

In the second process step (#12; FIG. 15), the hydraulic device (displacement means) causes displacement of the upper and lower mold members 32 and 24 towards the feed downstream side while the sheet material W is pressed (state of first step #11). That is, the sheet material W is fed to the feed downstream side.

Figure 16A:
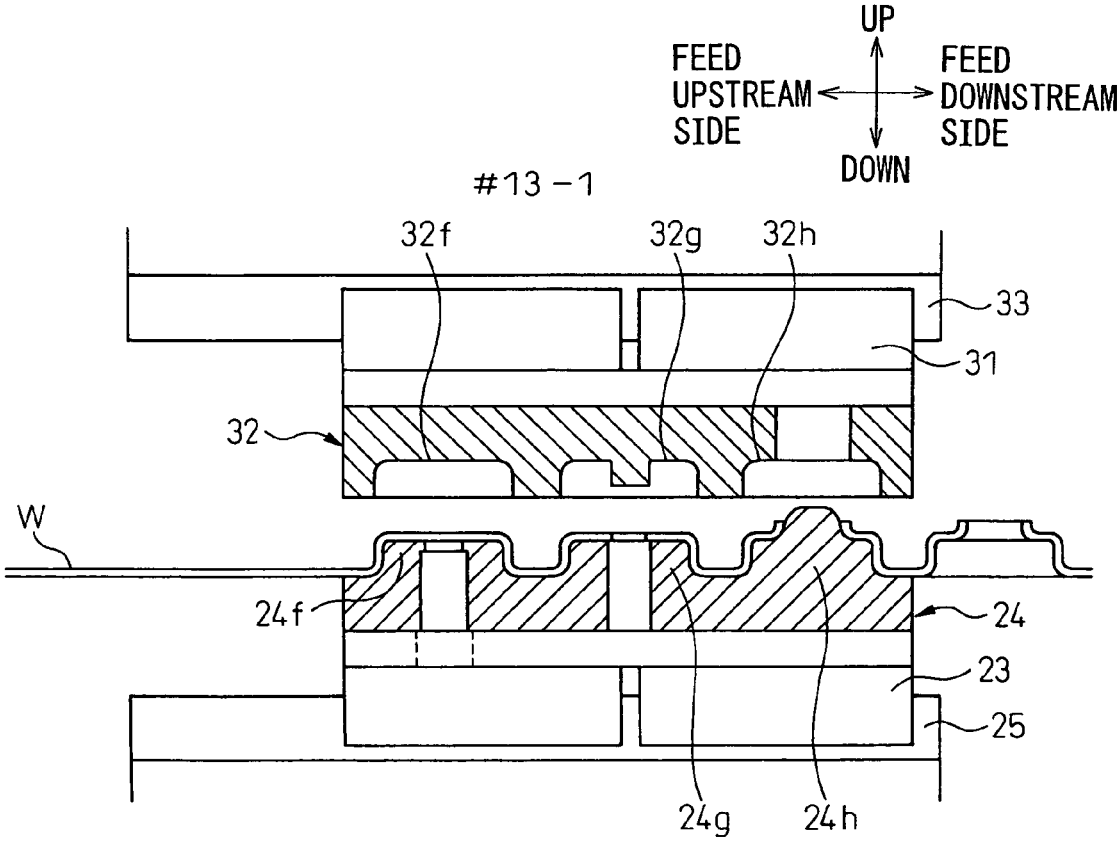
Figure 16B:
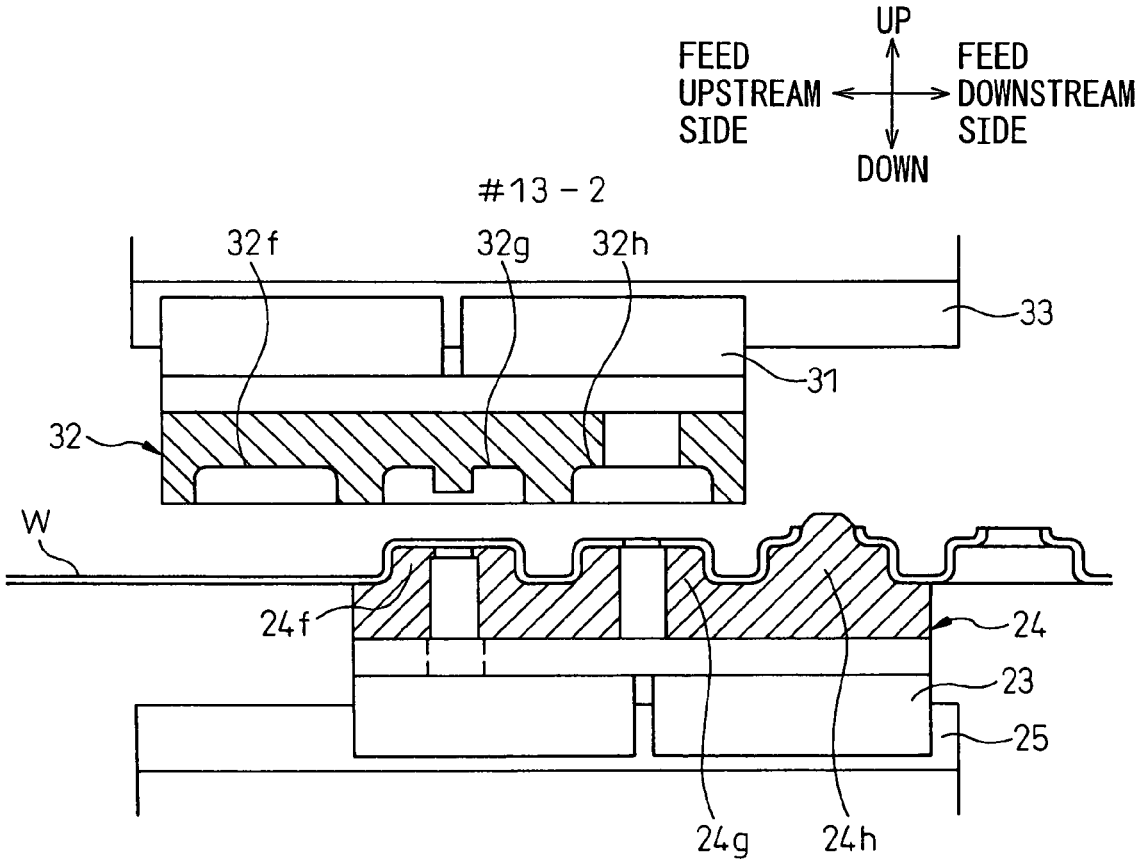

In the former half of the third step (#13-1; FIG. 16A), the hydraulic device (displacement means) moves the upper mold member 32 up. At this time, the sheet material W is held by the lower mold member 24. In the latter half of the third step (#13-2; FIG. 16B), the hydraulic device (displacement means) displaces the upper mold member 32 after the move towards the feed upstream side of the sheet material W.

Figure 17:
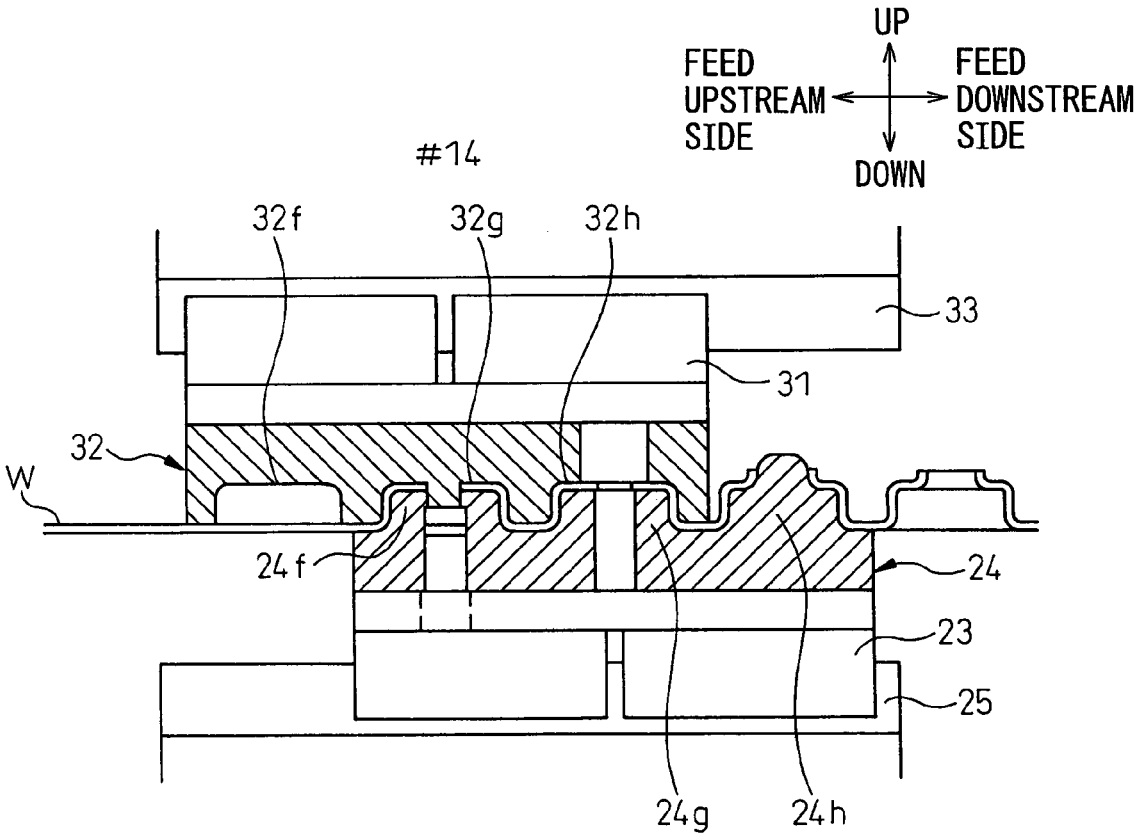
FIG. 17 is an enlarged view of principal portions of the press machine in the second embodiment and shows a fourth step.

Thereafter, the hydraulic device (displacement means) moves the upper mold member 32 down and presses the sheet material W (fourth step #14; FIG. 17). At this time, the intermediate recess portion 32*g* and the upstream punch 24*f* fit to each other and the downstream recess portion 32*h* and the intermediate punch 24*g* fit to each other. Because the intermediate recess portion 32*g* and the upstream punch 24*f* fit to each other, the afore-mentioned lower port portion for burring is formed in the sheet material W.

Figure 18A:
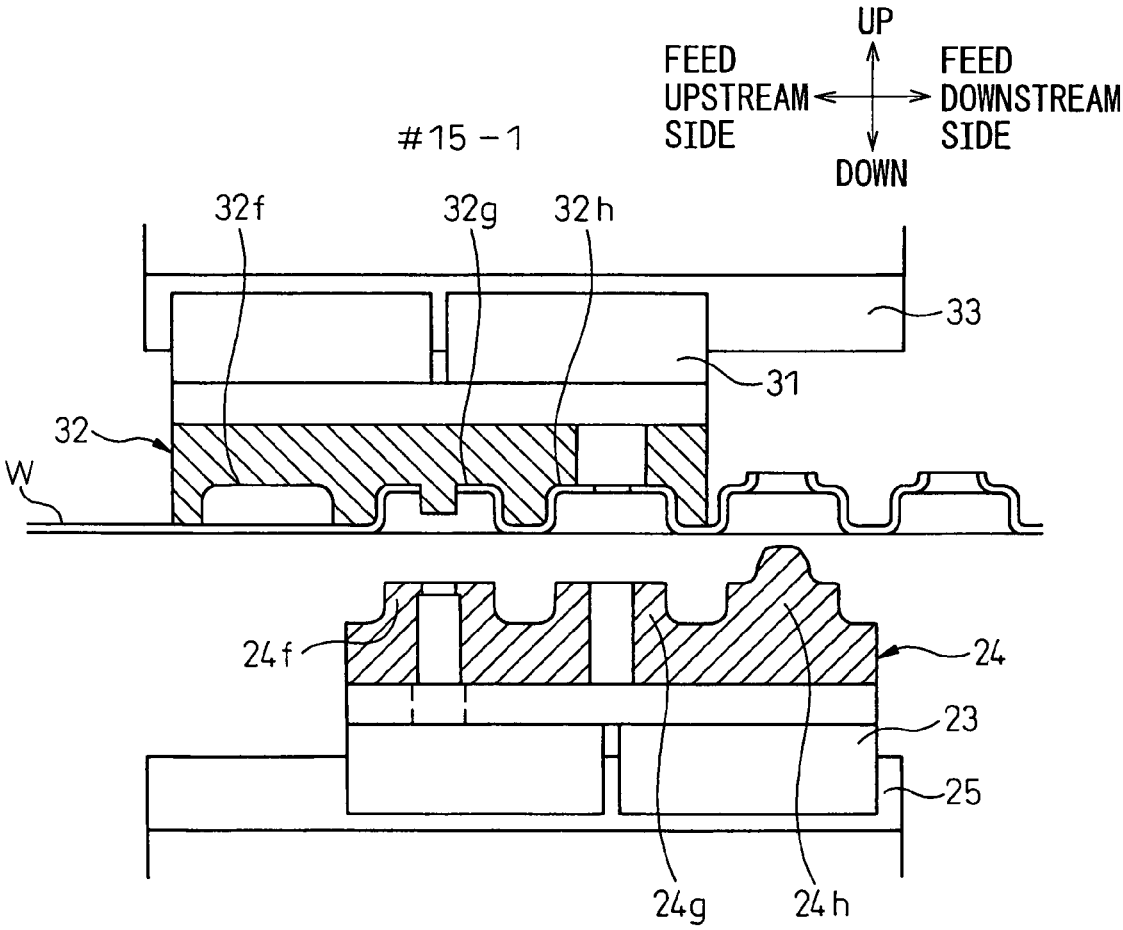
Figure 18B:
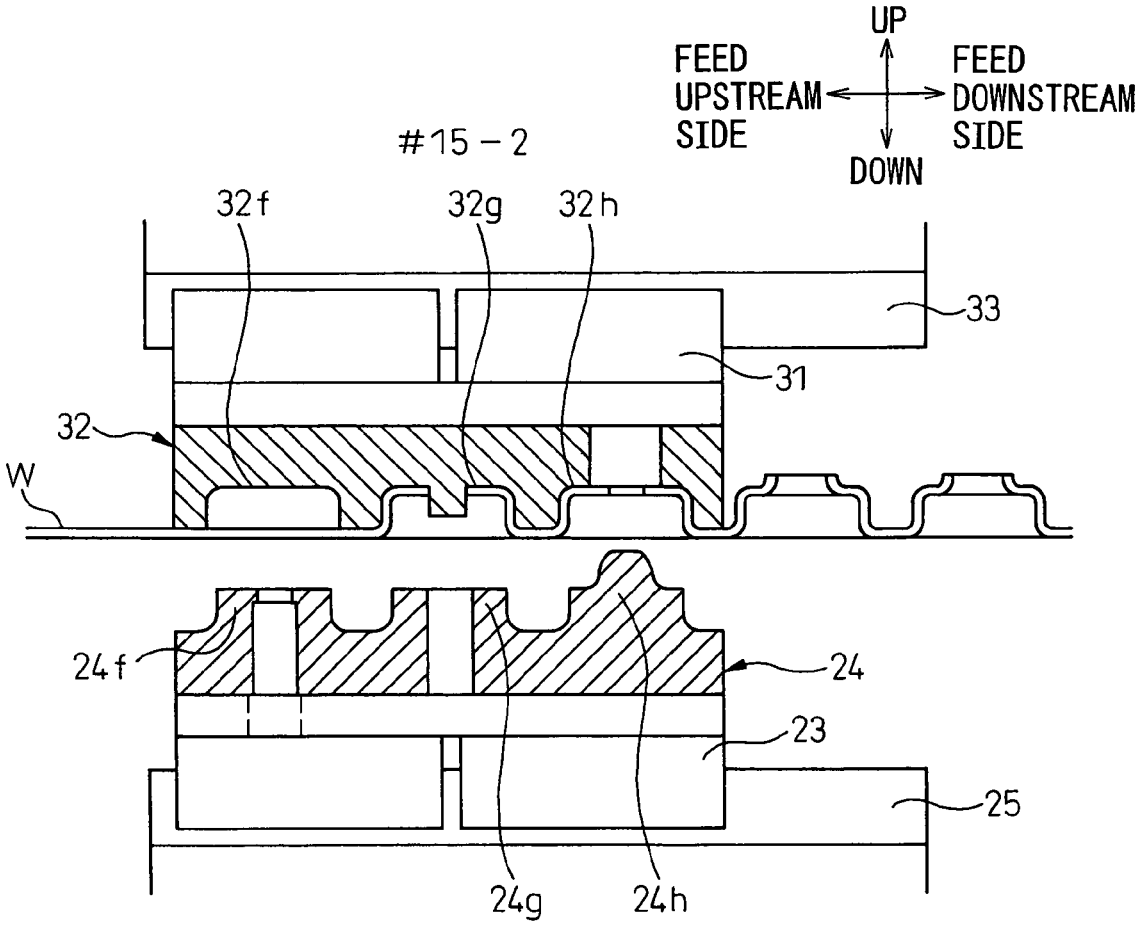

Next, the hydraulic device (displacement means) moves the lower mold member 24 (former half of fifth step #15-1; FIG. 18A) down. At this time, the sheet material W is held by the upper mold member 32. The hydraulic device (displacement means) displaces the lower mold member 24 after the move towards the feed upstream side of the sheet material W (latter half of fifth step #15-2; FIG. 18B). When the hydraulic device (displacement means) thereafter moves the lower mold member 24 up, the state of the first step (#11) is reached. Incidentally, this embodiment represents the processing method of a water injection port of an aluminum tank for a radiator having a burring shape but the processed product and processing to the sheet material area not limited to those of the embodiment. According to this embodiment, the sheet material W is displaced in the feed downstream direction in the second step (#12) while the upper mold member 32 and the lower mold member 24 fit to each other (press). Therefore, the feed device of the sheet material W that is indispensably necessary in Japanese Unexamined Patent Publication No. 2003-115567 can be eliminated and the cost of the press machine can be reduced.

Accuracy of the product can be improved because slip and deviation of the material do not exist during feed of the sheet material W and during pressing by the upper and lower mold members 32 and 24.

More specifically, because the sheet material W is fed in the second step (#12) under the state where the upper and lower mold members 32 and 24 fit to each other, slip of the material does not occur irrespective of the thickness of the material and its constituent material and the sheet material W can be fed highly accurately.

After the upper mold member 32 undergoes displacement while the lower mold member 24 holds the sheet material W in the third step (#13-1, #13-2), it fits to the lower mold member 24 in the fourth step (#14). On the other hand, after the upper mold member 32 undergoes displacement towards the feed upstream side while holding the sheet material W in the fifth step (#15-1, #15-2), the lower mold member 24 fits to the upper mold member 32 in the first step (#11).

In other words, because the upper mold member 32 and the lower mold member 24 execute pressing of the sheet material W restricted in the form corresponding to the punches 24*f*, 24*g* and 24*h* or to the intermediate recess portion 32*g* and the downstream recess portion 32*h*, deviation of the material does not occur during pressing. These effects can further synergistically improve the accuracy of the product. These effects are particularly effective in the press machine that executes multiple process steps, as in this embodiment.

Other Embodiments

The first embodiment described above represents the case where the slits 24*d* and 32*d* are arranged at both ends of the mold members 24 and 32 but the number of slits and their arrangement positions may be changed depending on the width of the sheet material W, and so forth.

The first and second embodiments described above represent the cases where they use respectively the cam mechanism and the hydraulic device as the displacement means but the displacement means of the mold members 24 and 32 are not limited to them. Namely, the displacement means can be variously changed such as means using an air pressure or a hydraulic cylinder, a linear motor or a device that converts displacement of the rotation of a motor to linear displacement by screws, etc, and so forth.

The first embodiment represents the example where the shapes of the upper and lower mold members 32 and 24 correspond to the corrugated fins but the shapes of the mold members can be naturally changed depending on the shape of the product required. The press machine of the sheet material having the effect of the invention can be constituted naturally even when the number of punches increases.

The first embodiment described above represents the example where the upper guide portion 41*a* hold the sheet material W to the lower mold member 24 and the lower guide portion 42*a* hold the sheet material W to the upper mold member 32. However, the holding method of the sheet material can be variously changed to a method that sucks air from apertures formed in the mold members 24 and 32 and holds the sheet material W by the negative pressure, a method that holds the sheet material W to the mold members 24 and 32 by the magnetic force, and so forth. The guide portions 41*a* and 42*a* can be fitted in the second embodiment, too.

The embodiments described above represent the example where the sheet material W is fed in the horizontal direction but the feeding direction can be variously changed such as the vertical direction.

While the invention has been described by reference to specific embodiments chosen for the purpose of illustration, it should be apparent that numerous modifications could be made thereto by those skilled in the art without departing from the basic concept and scope of the invention.

The invention claimed is:

1. A method for pressing a sheet of material having a width direction and a longitudinal direction, the method comprising:

a first step of forming said sheet of material by fitting a first mold member and a second mold member in such a manner as to sandwich said sheet of material between them; and a second step of causing said first mold member and said second mold member to displace in the longitudinal direction of said sheet of material while said first mold member and said second mold member keep the state of said first step.

2. A method for pressing a sheet of material comprising:

providing the sheet of material between a first and second mold member in a feed direction;

providing a first upstream punch arranged on the first mold member;

providing a first recess portion arranged on said first mold member on a feed direction downstream side of the sheet of material from said first upstream punch;

providing a first downstream punch arranged on said first mold member on the feed direction downstream side of said sheet of material from said first recess portion;

providing a second upstream punch arranged on said second mold member on a feed direction upstream side of the sheet of material from said first upstream punch, the second upstream punch being shaped to fit into the first recess portion;

providing a second recess portion arranged on said second mold member on the feed direction downstream side of said sheet of material from said second upstream punch, the second recess portion being shaped to accept said first upstream punch and said first downstream punch; and providing a second downstream punch arranged on said second mold member on the feed direction downstream side of said sheet of material from said second recess portion, the second downstream punch being shaped to fit into said first recess portion;

fitting said first upstream punch into said second recess portion and said first recess portion into said second downstream punch to thereby form said sheet of material;

causing said first mold member and said second mold member to undergo displacement in the feed direction downstream side of said sheet of material while said first mold member and said second mold member keep the state of said fitting step;

separating said first mold member from said second mold member while said second mold member holds said sheet of material and then causing said first mold member to undergo displacement to the feed direction upstream side of said sheet of material;

moving said first recess portion onto said second upstream punch and said first downstream punch into said second recess portion to thereby form said sheet of material; and separating said second mold member from said first mold member while said first mold member holds said sheet of material and then causing said second mold member to undergo displacement to the feed direction upstream side of said sheet of material.

3. A method for pressing a sheet of material comprising:

providing the sheet of material between a first and second mold member in a feed direction;

providing an upstream recess portion arranged on the first mold member;

providing a downstream recess portion arranged on said first mold member on a feed direction downstream side of the sheet of material from said upstream recess portion;

providing an upstream punch arranged on the second mold member and shaped to fit into said upstream recess portion and into said downstream recess portion; and providing a downstream punch arranged on said second mold member on the feed direction downstream side of said sheet of material from said upstream punch and shaped to fit into said upstream recess portion and into said downstream recess portion;

fitting said upstream recess portion onto said upstream punch and said downstream recess portion onto said downstream punch to thereby form said sheet material;

causing said first mold member and said second mold member to undergo displacement in the feed direction of said sheet of material while said first mold member and said second mold member keep the state of said fitting step;

separating said first mold member from said second mold member while said second mold member holds said sheet of material and then causing said first mold member to undergo displacement in the feed direction upstream side of said sheet of material;

moving said downstream recess portion onto said upstream punch; and separating said second mold member from said first mold member while said first mold member holds said sheet of material and then causing said second mold member to undergo displacement in the feed direction upstream side of said sheet of material.

4. An apparatus for pressing a sheet of material comprising:

a first mold member and a second mold member fitting to each other while sandwiching the sheet of material between them; and displacement means for causing said first and second mold members to undergo displacement in a feed direction generally parallel to said sheet of material and a press direction generally perpendicular to said sheet of material, the displacement means being integrated with a shaft driven by a motor; the displacement means comprising:

a first integrated cam for causing said first mold member to undergo the displacement in the feed direction and the press direction; and a second integrated cam for causing said second mold member to undergo the displacement in the feed direction and the press direction.

5. An apparatus for pressing a sheet of material according to claim 4, further comprising:

a first upstream punch arranged on a first mold member;

a first recess portion arranged on said first mold member on a feed direction downstream side of the sheet of material from said first upstream punch;

a first downstream punch arranged on said first mold member on the feed direction downstream side of said sheet of material from said first recess portion;

a second upstream punch arranged on said second mold member on a feed direction upstream side the sheet of material from said first upstream punch, the second upstream punch being shaped to fit into said first recess portion;

a second recess portion arranged on said second mold member on the feed direction downstream side of said sheet of material from said second upstream punch, the second recess portion being shaped to accept said first upstream punch and said first downstream punch; and a second downstream punch arranged on said second mold member on the feed direction downstream side of said sheet of material from said second recess portion, the second downstream punch being shaped to fit into said first recess portion.

6. An apparatus for pressing machine of a sheet of material according to claim 4, further comprising:

an upstream recess portion arranged on the first mold member;

a downstream recess portion arranged on said first mold member on a feed direction downstream side of the sheet of material from said upstream recess portion;

an upstream punch arranged on the second mold member and shaped to fit into said upstream recess portion and into said downstream recess portion; and a downstream punch arranged on said second mold member on a feed direction downstream side of said sheet of material from said upstream punch and shaped to fit into said upstream recess portion and into said downstream recess portion.

7. An apparatus for pressing a sheet of material according to claim 5, further comprising:

a first support member for causing said second mold member to hold said sheet of material when said first mold member separates from said second mold member; and a second support member for causing said first mold member to hold said sheet of material when said second mold member separates from said first mold member.

8. An apparatus for pressing a sheet of material according to claim 6, further comprising:

a first support member for causing said second mold member to hold said sheet of material when said first mold member separates from said second mold member; and a second support member for causing said first mold member to hold said sheet of material when said second mold member separates from said first mold member.

9. The apparatus for pressing a sheet of material according to claim 4, wherein the first integrated cam is a single piece component defining a first cam surface and a second cam surface.

10. The apparatus for pressing a sheet of material according to claim 9, wherein the second integrated cam is a single piece component defining a third cam surface and a fourth cam surface.

11. The apparatus for pressing a sheet of material according to claim 10, wherein said first and third cam surfaces are external cam surfaces and said second and fourth cam surfaces are internal cam surfaces.

12. The apparatus for pressing a sheet of material according to claim 9, wherein said first cam surface is an external cam surface and said second cam surface is an internal cam surface.

* * * * *